US012584713B2

(12) United States Patent
Munsell et al.

(10) Patent No.: US 12,584,713 B2
(45) Date of Patent: Mar. 24, 2026

(54) ADJUSTABLE APERTURE AXIS PEEP SIGHT DEVICE

(71) Applicant: HAMSKEA ARCHERY SOLUTIONS LLC, Frederick, CO (US)

(72) Inventors: Andrew W. Munsell, Brighton, CO (US); Devin Hall, Ft. Collins, CO (US)

(73) Assignee: Hamskea Archery Solutions LLC, Frederick, CO (US)

( * ) Notice: Subject to any disclaimer, the term of this patent is extended or adjusted under 35 U.S.C. 154(b) by 138 days.

(21) Appl. No.: 18/490,573

(22) Filed: Oct. 19, 2023

(65) Prior Publication Data

US 2024/0133658 A1 Apr. 25, 2024
US 2024/0230278 A9 Jul. 11, 2024

Related U.S. Application Data

(60) Provisional application No. 63/380,852, filed on Oct. 25, 2022.

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 124/87
See application file for complete search history.

(56) References Cited

U.S. PATENT DOCUMENTS 1,428,389 A 9/1922 Miller
2,061,017 A 11/1936 Arden
2,083,934 A 6/1937 Arden
2,125,932 A 8/1938 Lennon
2,814,284 A 11/1957 Sileo
2,842,114 A 7/1958 Duncan
3,410,644 A 11/1968 McLendon
3,431,652 A 3/1969 Lennon
3,703,770 A 11/1972 Sofield
3,703,771 A 11/1972 Saunders
3,859,733 A 1/1975 Chesnick
3,922,795 A 12/1975 Bettencourt
(Continued)

FOREIGN PATENT DOCUMENTS

DE 102020005025 A1 8/2020

OTHER PUBLICATIONS

"Podium Peep Apertures", 4 pages, Specialty Archery L.L.C., printed from: https://specialtyarch.com/podium-peep-apertures on Aug. 4, 2025 but available at least as early as Mar. 2, 2020.
(Continued)

*Primary Examiner* — John E Simms, Jr.
(74) *Attorney, Agent, or Firm* — Trenner Law Firm, LLC; Mark Trenner

(57) ABSTRACT

An adjustable aperture axis peep sight device is disclosed with an outer ring having a first axis, and an inner body member having a second axis. The first axis of the outer ring forms a sight angle with the second axis of the inner body member. A first partially spherical surface is formed on the outer ring. A second partially spherical surface is formed on the inner body member. The first partially spherical surface movably mates with the second partially spherical surface. The sight angle is adjustable by moving the inner body member relative to the outer ring.

18 Claims, 27 Drawing Sheets

(56) References Cited

U.S. PATENT DOCUMENTS

| | | | | |
|---|---|---|---|---|
| 4,011,853 | A | 3/1977 | Fletcher | |
| 4,217,026 | A | 8/1980 | Radovich | |
| 4,375,725 | A | 3/1983 | Orlob | |
| 4,395,096 | A | 7/1983 | Gibson | |
| 4,542,963 | A | 9/1985 | Linlor | |
| 4,552,121 | A | 11/1985 | Treaster | |
| 4,656,747 | A | 4/1987 | Troncoso | |
| 4,833,786 | A * | 5/1989 | Shores, Sr. | F41G 1/01 42/133 |
| 5,004,332 | A | 4/1991 | Edwards | |
| 5,093,837 | A | 3/1992 | Edwards | |
| 5,121,251 | A | 6/1992 | Edwards | |
| 5,225,931 | A | 7/1993 | Stavroudis | |
| 5,347,976 | A | 9/1994 | Saunders | |
| 5,367,780 | A | 11/1994 | Savage | |
| 5,371,369 | A | 12/1994 | Kent | |
| 5,669,146 | A | 9/1997 | Beutler | |
| 5,697,357 | A | 12/1997 | Chipman | |
| 5,860,408 | A * | 1/1999 | Summers | F41G 1/467 124/90 |
| 6,024,458 | A | 2/2000 | Lundgren | |
| 6,058,921 | A | 5/2000 | Lawrence et al. | |
| 6,170,164 | B1 | 1/2001 | Knowles | |
| 6,239,922 | B1 | 5/2001 | Nakamura | |
| 6,282,800 | B1 * | 9/2001 | Beutler | F41G 1/467 124/87 |
| 6,360,473 | B1 | 3/2002 | Merchant | |
| 6,802,129 | B1 | 10/2004 | Wirth | |
| 7,047,652 | B1 | 5/2006 | Chipman | |
| 7,266,896 | B1 | 9/2007 | White | |
| 7,286,295 | B1 | 10/2007 | Sweatt et al. | |
| 7,373,723 | B1 | 5/2008 | Tupper, Jr. | |
| 7,461,460 | B2 | 12/2008 | Priebe | |
| 7,543,389 | B2 | 6/2009 | Grace, Jr. | |
| 7,698,824 | B2 | 4/2010 | Wilson | |
| 7,762,677 | B2 | 7/2010 | Lundgren | |
| 7,975,391 | B1 | 7/2011 | Gillingham et al. | |
| 8,000,010 | B2 | 8/2011 | Crandall | |
| 8,125,628 | B1 | 2/2012 | Lones | |
| 8,161,656 | B1 | 4/2012 | Ellgass | |
| 8,176,644 | B1 | 5/2012 | Summers et al. | |
| 8,191,544 | B2 | 6/2012 | Buck | |
| 8,453,336 | B2 * | 6/2013 | LoRocco | F41G 1/467 124/87 |
| 8,544,180 | B2 | 10/2013 | Minica | |
| 8,544,457 | B1 | 10/2013 | Munsell et al. | |
| 9,285,188 | B1 | 3/2016 | LoRocco et al. | |
| 9,829,278 | B2 | 11/2017 | Wolf et al. | |
| 9,921,033 | B2 | 3/2018 | Johnson | |
| 10,012,473 | B2 | 7/2018 | Munsell et al. | |
| 10,041,765 | B2 * | 8/2018 | McMakin | F41G 1/38 |
| 10,161,719 | B2 | 12/2018 | Sanches et al. | |
| 10,436,542 | B1 | 10/2019 | Karcher | |
| D869,591 | S | 12/2019 | Schuster | |
| 10,746,499 | B2 | 8/2020 | Munsell | |
| 10,852,097 | B2 | 12/2020 | Wilson et al. | |
| 11,385,032 | B2 | 7/2022 | Wilson | |
| 12,050,080 | B2 * | 7/2024 | Bowmar | F41B 5/1423 |
| 2007/0050998 | A1 | 3/2007 | Myers | |
| 2008/0066328 | A1 * | 3/2008 | Bohn | F41G 1/467 124/87 |
| 2009/0007445 | A1 | 1/2009 | Bach | |
| 2011/0186028 | A1 | 8/2011 | VandeWater | |
| 2018/0087874 | A1 * | 3/2018 | Wolf | F41G 1/467 |
| 2018/0112950 | A1 * | 4/2018 | Munsell | F41B 5/1419 |
| 2019/0277601 | A1 * | 9/2019 | Hanley | F41G 1/467 |
| 2020/0217614 | A1 * | 7/2020 | Schuster | F41B 5/1419 |
| 2020/0292277 | A1 * | 9/2020 | Munsell | F41G 1/01 |
| 2022/0325978 | A1 | 10/2022 | Hall et al. | |
| 2022/0397370 | A1 | 12/2022 | Munsell et al. | |
| 2023/0272995 | A1 | 8/2023 | Munsell et al. | |

OTHER PUBLICATIONS

"Sako Optilock TM" printed from http://www.sako.fi/scope-mounts on Apr. 13, 2016, 6 pages.

Google Patents English Translation of DE102020005025A1 printed from https://patents.google.com/patent/DE102020005025A1/en?oq=DE102020005025A1 on Aug. 4, 2025.

* cited by examiner

PRIOR ART

PRIOR ART

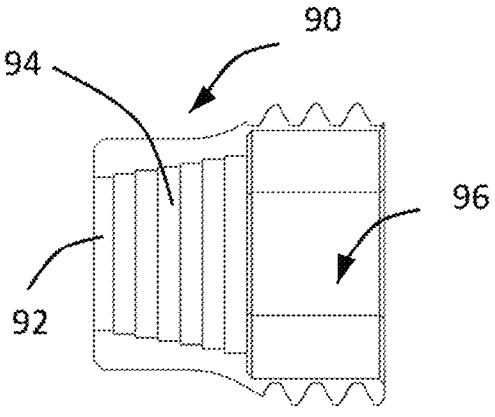
Fig. 26A
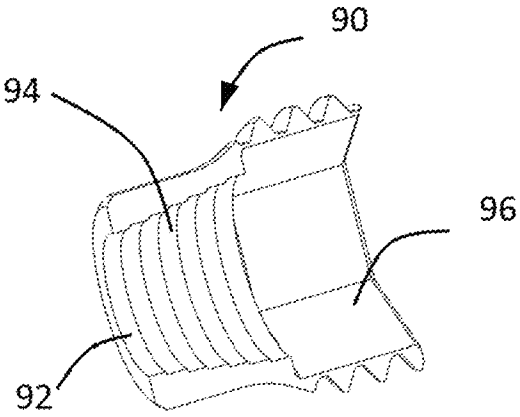
Fig. 26B
Fig. 26C

ADJUSTABLE APERTURE AXIS PEEP SIGHT DEVICE

PRIORITY

This application claims the priority filing benefit of U.S. Provisional Patent Application No. 63/380,852 filed Oct. 25, 2022 for "Adjustable Aperture Axis Peep Sight Device" of Munsell and Hall, hereby incorporated by reference in its entirety as though fully set forth herein.

BACKGROUND

In an archery sighting system, the two major components for consistent and repeatable aiming include a front aperture with an aiming reticle, and a rear aperture known as a "peep" sight. Maximum accuracy is achieved when the two are coaxially aligned. However, the aperture axis of the peep sight often is not coaxially aligned with the line-of-sight to the target through the front aperture due to the variability of the bow geometry fitted to the archer and the resultant string angle as the peep is mounted to the string.

Depending on the length of the bow (from limb-to-limb), and the draw length of the archer, when the bow is at full draw, the string angle can vary from approximately 35 degrees to 55 degrees as measured from the horizontal Line-of-Sight (LOS) to the target. Rear peep sights specifically have fixed mechanical features or grooves on opposite sides of the outer diameter of the housing that mount and align the housing to the bow string. As a result, the peep sight is constrained from being able to accommodate all the string angles that are produced by the combination of the archer's draw length and the bow geometry.

The string mounting grooves of the peep are fixed in position and set the angular position of the peep housing relative to the bow string and the LOS to the target. Because peep housings are small in outside diameter (less than 0.75") there are a limited number of these alignment grooves that can be incorporated in the housing. Typically, a maximum of two string groove pairs (i.e., a total of 4 grooves) can be accommodated in the peep housing. Angle pairs are generally 52 degrees and 47 degrees, 47 degrees and 42 degrees, or 42 degrees and 37 degrees. If the string angle does not match these predetermined groove angles, then the peep aperture axis will not be co-aligned with the LOS to the target. This results in inaccuracies when co-aligning the front sight aperture with the peep sight's rear aperture with the LOS.

There remains a need to have the ability to optimize and personalize the angle of the peep aperture axis when the peep is mounted in the bow string in a fixed orientation.

BRIEF DESCRIPTION OF THE DRAWINGS

FIGS. 26A, 26B and 26C_are component views showing an example rearward facing aperture insert.

DETAILED DESCRIPTION

Figure 1B:
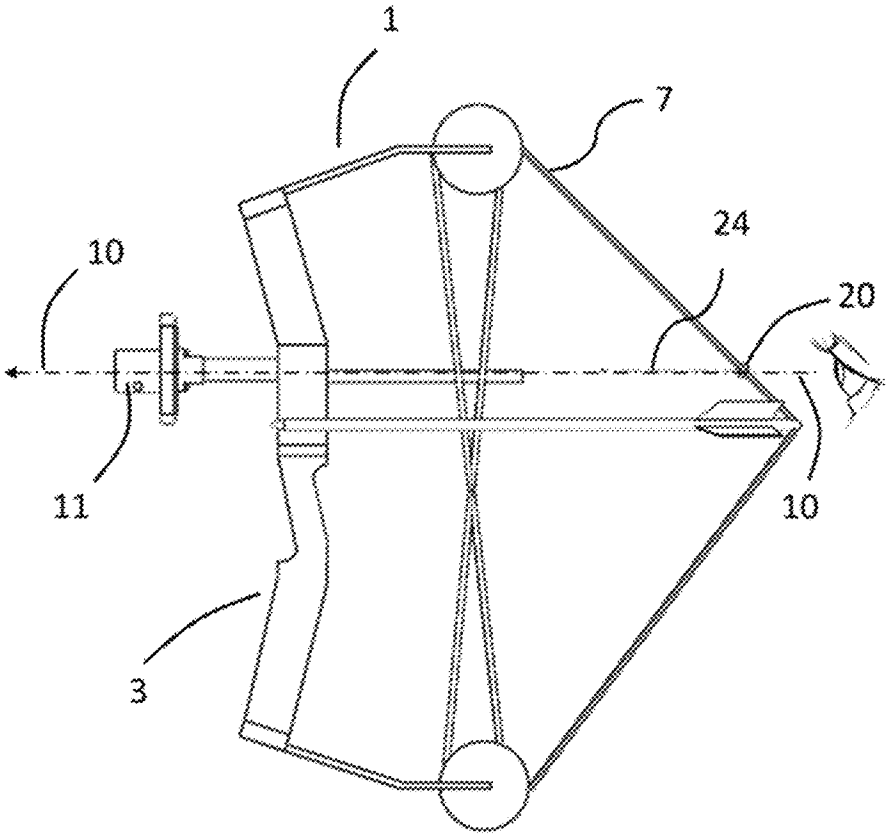
FIGS. 1A and 1B are perspective views of an example bow system at rest and at full draw.

A peep sight assembly device is disclosed. An example adjustable aperture axis peep sight device includes an outer ring having a first axis, and an inner body member having a second axis. The first axis of the outer ring forms a sight angle with the second axis of the inner body member. A first partially spherical surface is formed on the outer ring. A second partially spherical surface is formed on the inner body member. The first partially spherical surface movably mates with the second partially spherical surface. The sight angle is adjustable by moving the inner body member relative to the outer ring.

Another example adjustable aperture axis peep sight device includes an outer ring having a first partially spherical surface, and an inner body member having a second partially spherical surface. The first partially spherical surface mates with the second partially spherical surface. The inner body member moves relative to the outer ring. The example adjustable aperture axis peep sight device may also include a forward facing (toward the target) insert assembly having a lens cavity and rearward facing (toward the archery) inserts to set the peep aperture size. The forward facing insert assembly is insertable into a front portion of the inner body member. A rearward facing aperture is insertable into the rearward portion of the inner body. A leveling device may be provided on or in the inner body member to assess a position of the second axis of the inner body member relative to a line-of-sight axis to a target where the angle between the second axis of the inner body member and the line-of-sight axis to the target is near zero.

Another example adjustable aperture axis peep sight device includes an outer body member having first mounting means, and an inner body member having a second mounting means. The first mounting means movably mates with the second mounting means. The inner body member moves relative to the outer body member. The outer body member compresses the inner body member through a clamping force applied by a fastener that reduces a diameter of the outer body member, fixing the inner body member relative to the outer ring. In an example, the inner body member is adjusted independent of the outer body member over an angular range phi 34 ($\angle\phi$) of approximately +/−10 degrees when the clamping force is not applied.

In an example, the outer body member is secured to the bowstring at a fixed angular position, generally at 45 degrees. The inner body member independently pivots relative to the outer body member when the inner and outer body members are coupled. Adjusting the inner body member adapts the angular relation between the aperture axis of the inner body member to the line-of-sight to the target independent of the outer body member being fixed to the string at an angle when at full draw.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples described herein are provided for purposes of illustration, and are not intended to be limiting. Other devices and/or device configurations may be utilized to carry out the operations described herein.

The operations shown and described herein are provided to illustrate example implementations. It is noted that the operations are not limited to the ordering shown. Still other operations may also be implemented.

Figure 1A:
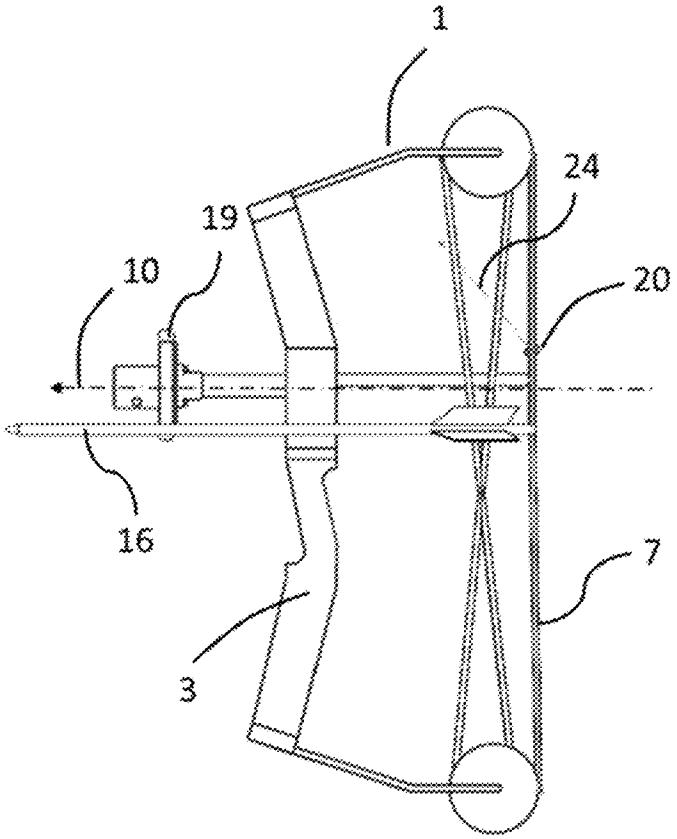
Fig. 1A PRIOR ART
Figure 2:
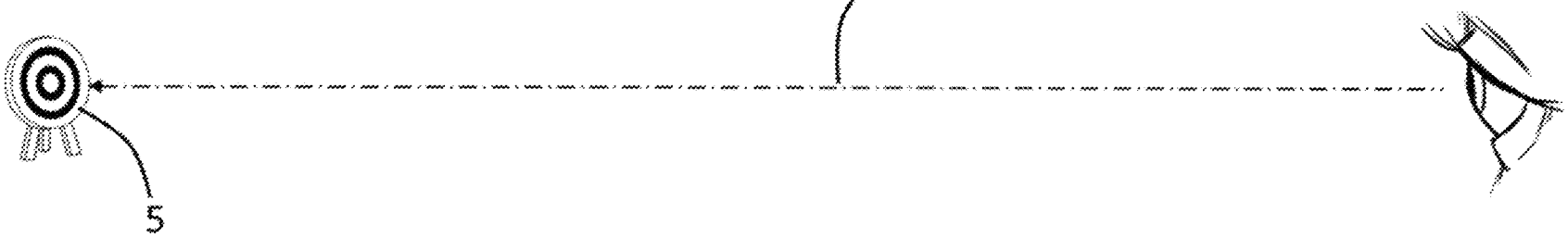
Fig. 2 PRIOR ART
FIG. 2 is a perspective view of an example Line-Of-Sight (LOS) to the target.

FIGS. 1A and 1B are perspective views of an example bow system at rest and at full draw. FIG. 2 is a perspective view of an example Line-Of-Sight (LOS) 10 to the target 5. When aiming a modern archery bow system 1, the front sight aperture 11 and the conventional rear peep sight 20 and aperture 22 are used in conjunction for aligning the bow system 1 to the aiming line-of-sight (LOS) 10 to the target 5.

Figure 3:
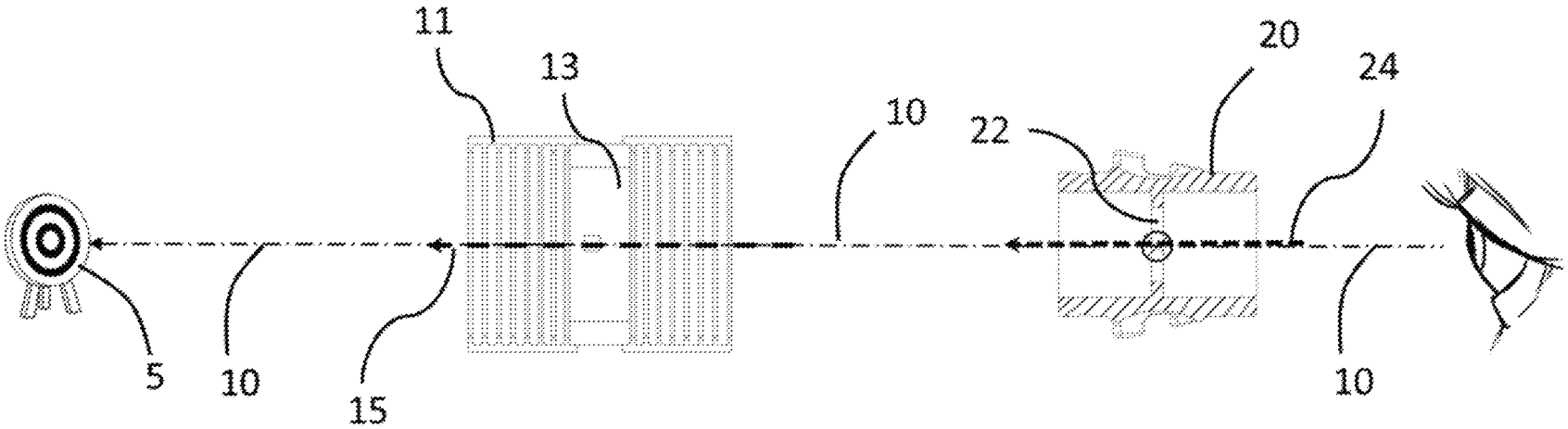
Fig. 3 PRIOR ART
FIG. 3 shows an example Line-of-Sight (LOS) to the target with co-aligned front sight and rear peep.
Figure 4:
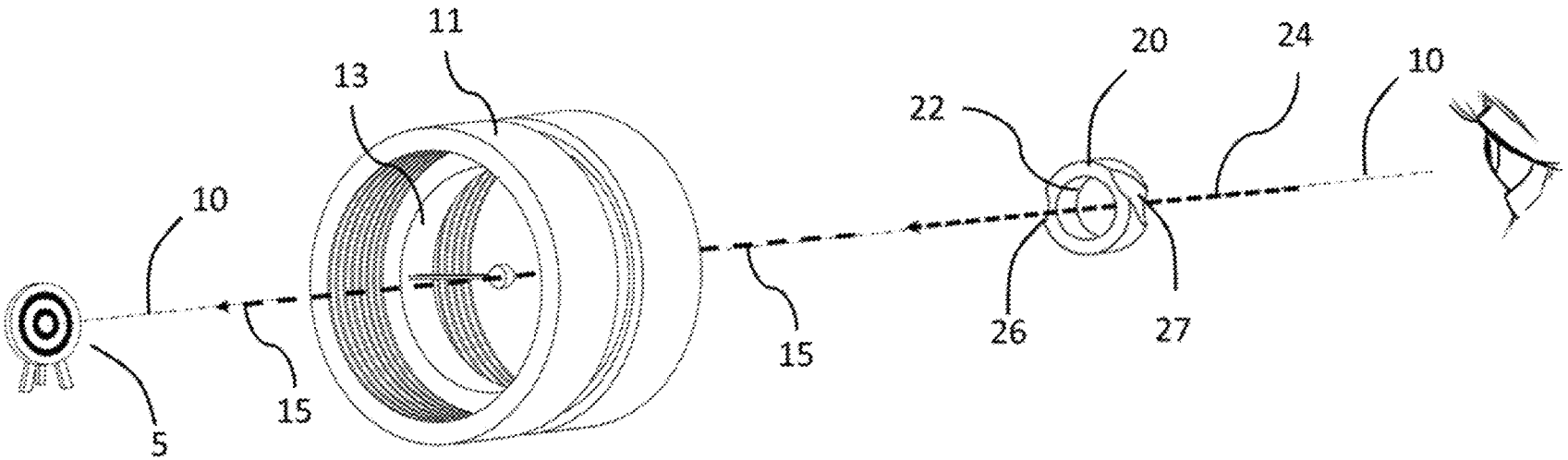
PRIOR ART Fig. 4
FIG. 4 is an isometric view of the example Line-of-Sight (LOS) to the target co-aligned with front sight and rear peep.
Figure 5:
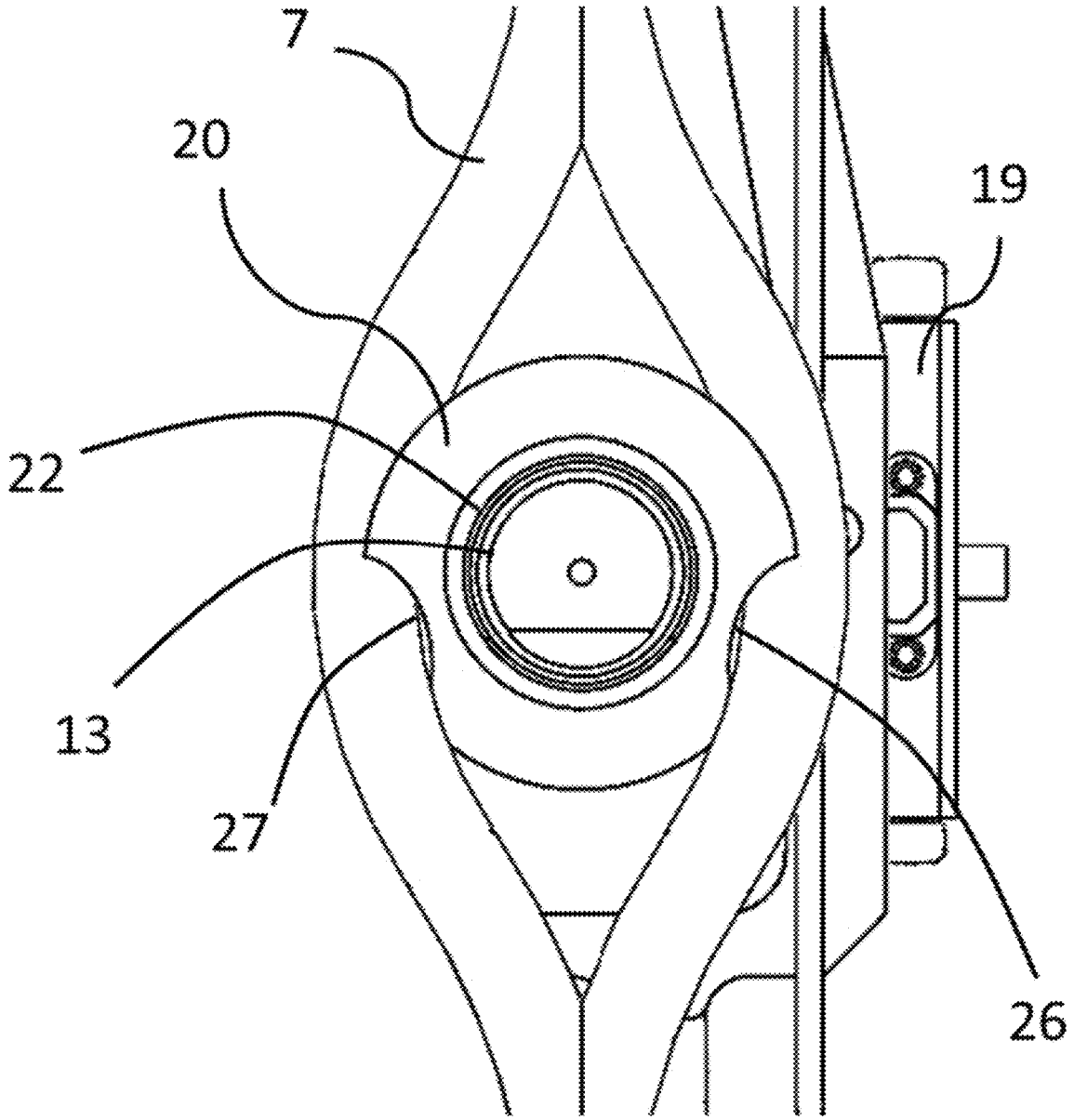
FIG. 5 is an example archer's perspective view of the Line-of-Sight (LOS) to the target with co-aligned front sight and rear peep.
Figure 6:
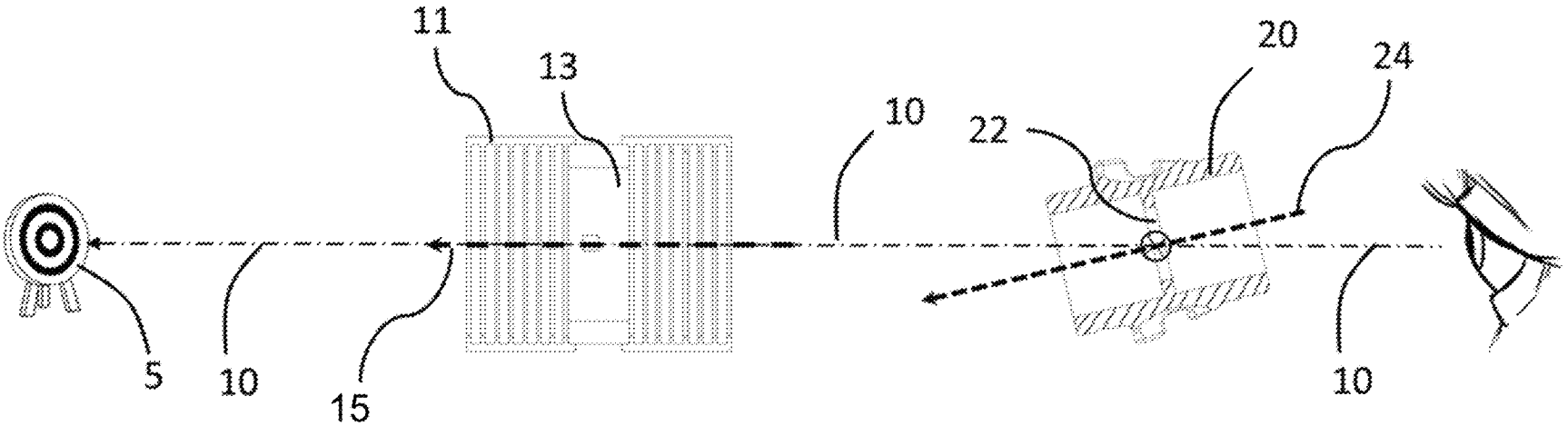
Fig. 6 PRIOR ART
FIG. 6 shows an example Line-of-Sight (LOS) to the target with co-aligned front sight and misaligned rear peep.

FIG. 3 shows an example Line-of-Sight (LOS) 10 to the target 5 with co-aligned front sight 11 and rear peep 20. FIG. 4 is an isometric view of the example Line-of-Sight (LOS) 10 to the target 5 co-aligned with front sight and rear peep. FIG. 5 is an example archer's perspective view of the Line-of-Sight (LOS) 10 to the target 5 with co-aligned front sight and rear peep where line-of-sight axis 10 to the target and the peep axis 24 is near zero. FIG. 6 shows an example Line-of-Sight (LOS) 10 to the target 5 with co-aligned with the front sight axis 15 and misaligned rear peep axis 24.

Figure 7:
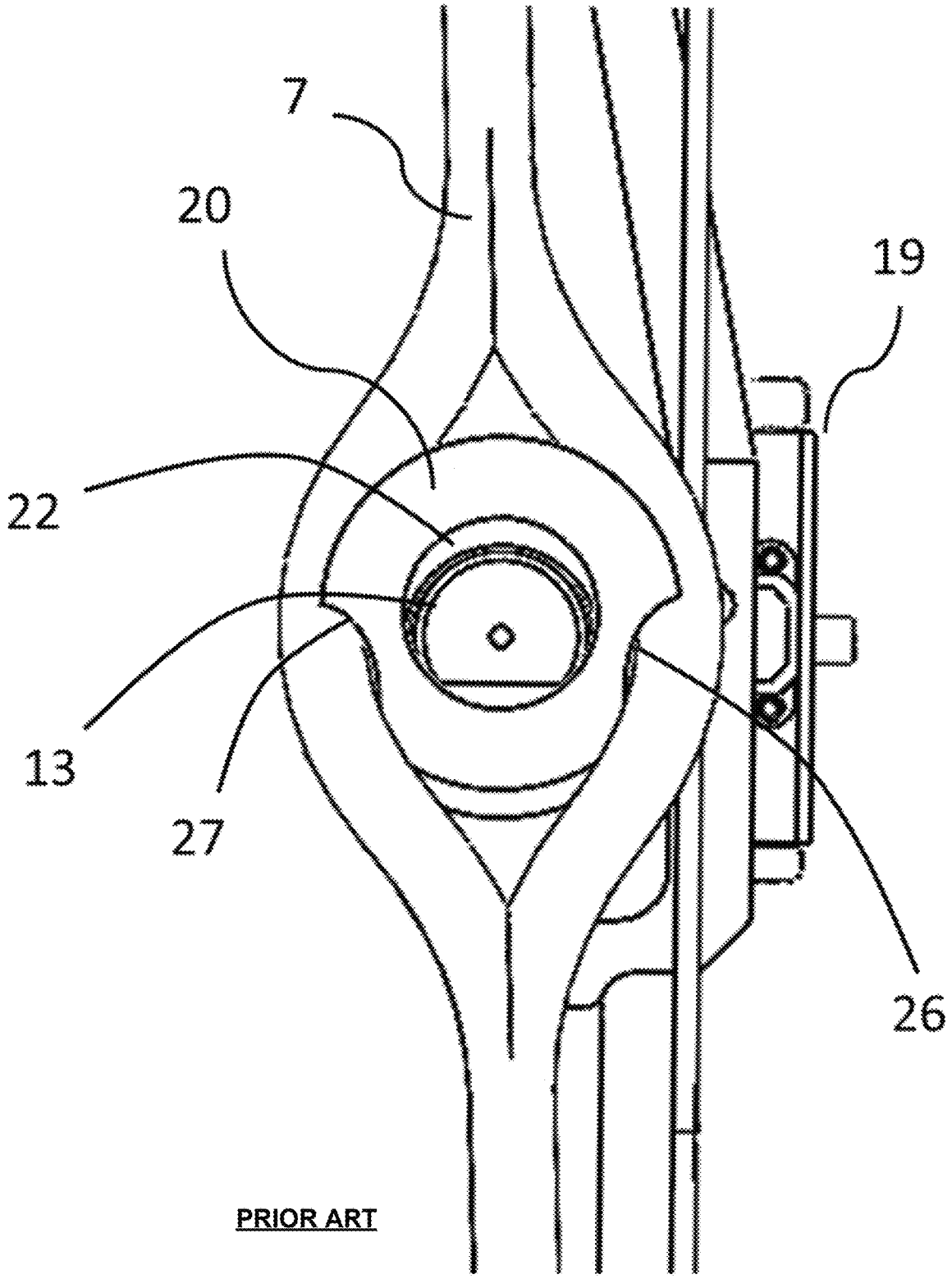
FIG. 7 shows an example archer's perspective view of the Line-of-Sight (LOS) to the target with co-aligned front sight and misaligned rear peep.

FIG. 7 shows an example archer's perspective view of the Line-of-Sight (LOS) 10 to the target 5 with co-aligned front sight 13 and misaligned rear peep 20 and peep inner aperture 22. The most accurate orientation of these two aiming components are when these are coaxially aligned with the LOS 10 to the target 5 (FIG. 3). In this orientation, the archer sees concentric circles (FIG. 5) resulting in the archer effectively looking through one circular aperture. If either of the aiming apertures 13 and 22 are not co-aligned, the archers will instead see an oval shape, indicating a co-alignment error (i.e., non-concentric rings, FIG. 7).

The front aiming housing 11 with aperture 13 is attached to a front sight 19 which has multiple adjustments to co-align the front sight aperture axis 15 with the LOS 10 to the target 5 (FIG. 1). The rear peep sight 20 is mechanically attached to the string 7 of the bow 3 in a fixed orientation. The angle 30 ($\angle\alpha$) of the bow string 7 (or "string angle") relative to the LOS 10 to the target 5, varies depending on the vertical length of the bow 3 and how far the archer can draw the bow back (e.g., the draw length at full draw).

Figure 8B:
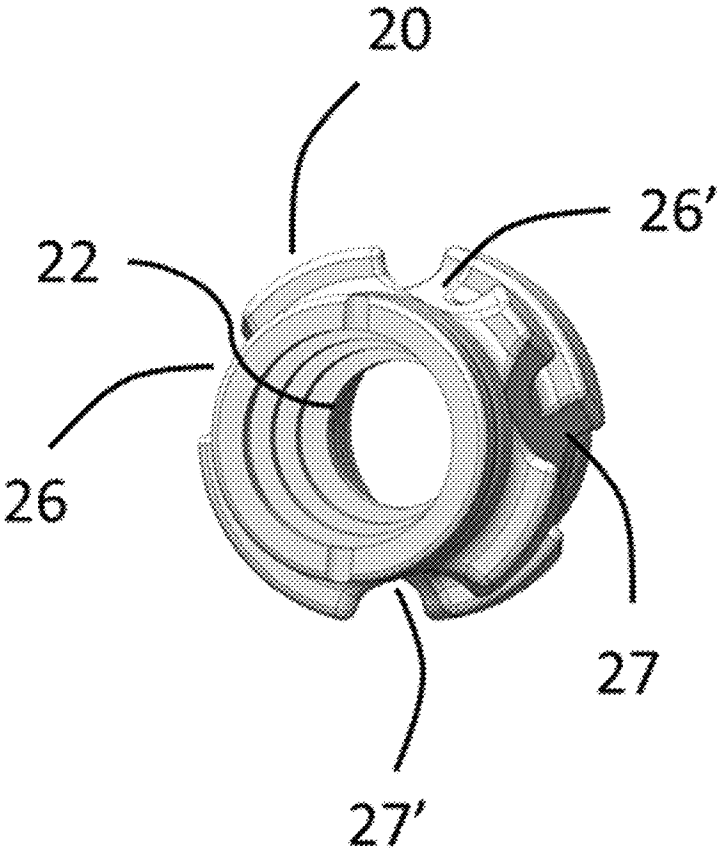
FIGS. 8A and 8B show examples of a conventional rear peep with fixed string groove pairs-single pair (L) and two pair (R).
Figure 8A:
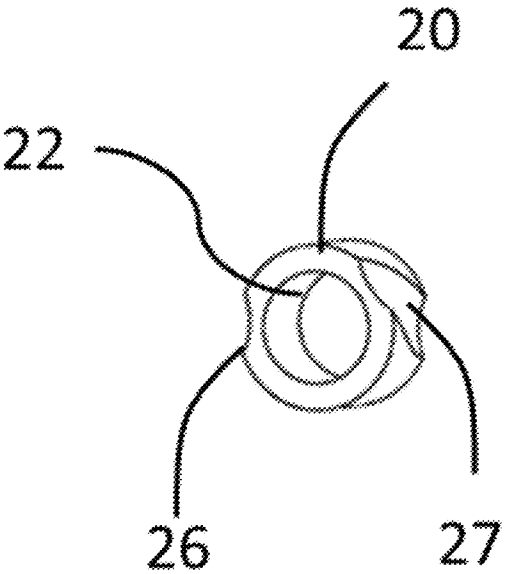
Fig. 8A PRIOR ART
Figure 9:
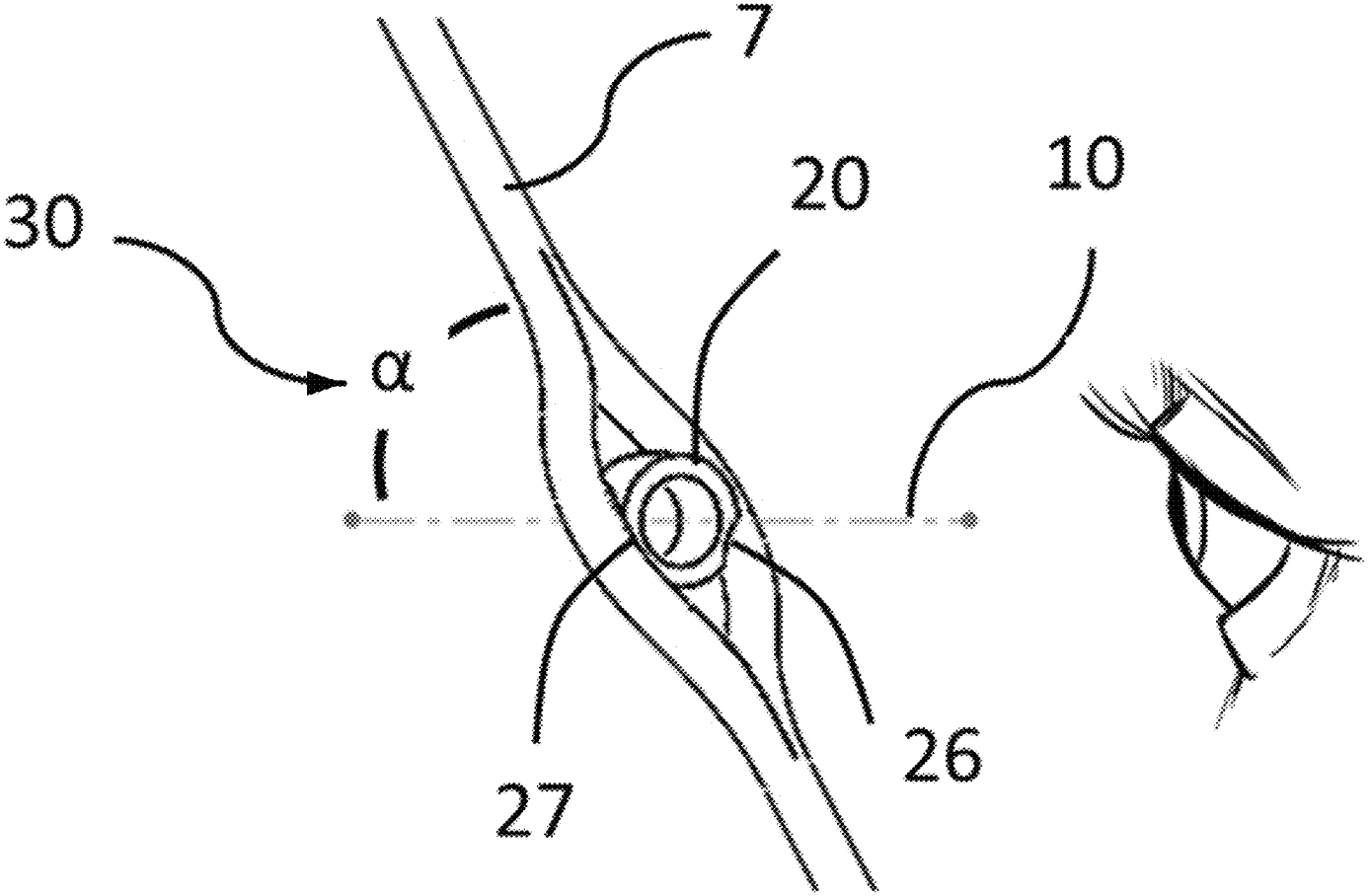
PRIOR ART Fig. 9
FIG. 9 shows an example of a conventional rear peep with fixed string groove pairs installed in a bow string with the bow at full draw and Line-of-Sight (LOS) through the rear peep.
Figure 10:
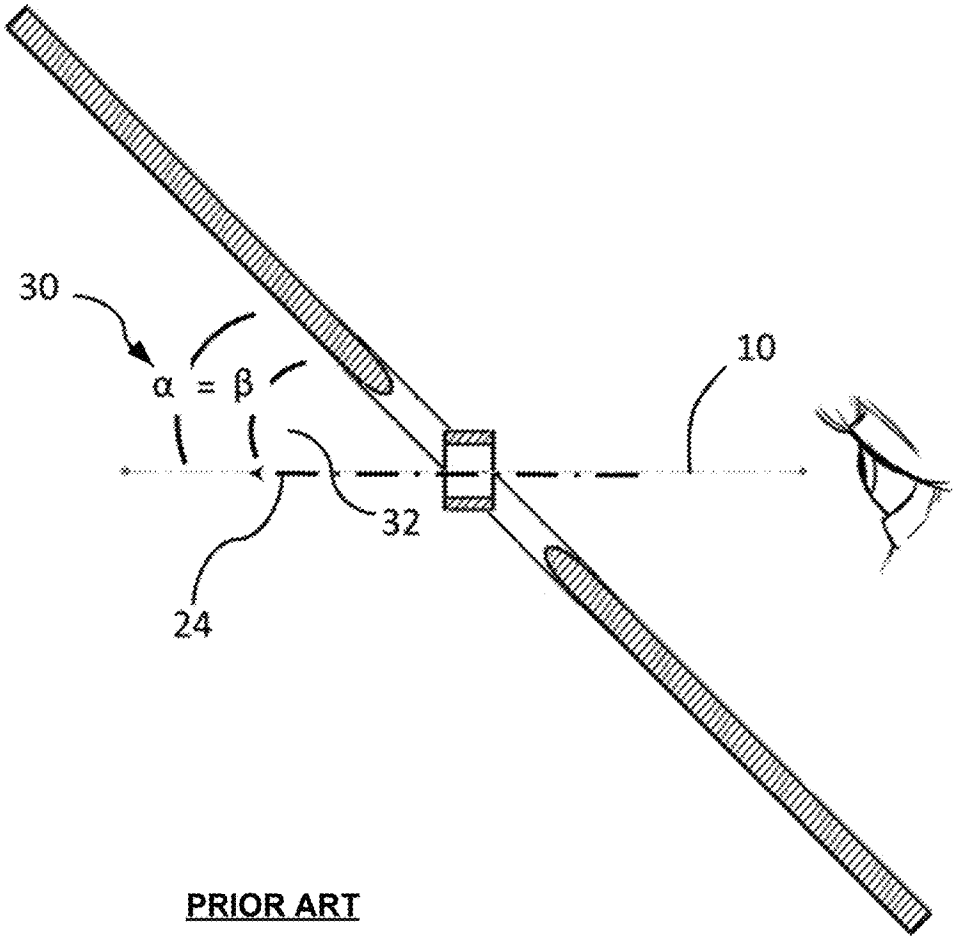
PRIOR ART Fig. 10
FIG. 10 shows an example of a conventional rear peep with fixed string groove pairs installed in a bow string with the bow at a full draw, with Line-Of-Sight (LOS) angle Alpha and Peep Aperture axis angle Beta equal and co-aligned.

FIGS. 8A and 8B show examples of a conventional rear peep with fixed string groove pairs-single pair 26 and 27 (L) and two pair 26' and 27' (R). FIG. 9 shows an example of a conventional rear peep with fixed string groove pairs installed in a bow string 7 with the bow at full draw and Line-of-Sight (LOS) 10 through the rear peep where the angle Alpha 30 represents the fixed angle between the two. When the angle Alpha 30 equals the string groove angles pairs 26, 27 or 26', 27' the error between the peep axis 24 and the line of sight 10 is zero. FIG. 10 shows an example of a conventional rear peep with fixed string groove pairs installed in a bow string with the bow at a full draw, with Line-Of-Sight (LOS) 10 angle Alpha and Peep Aperture axis angle Beta equal and co-aligned. FIGS. 11A and 11B show examples of a conventional rear peep axis not co-aligned with the Line-Of-Sight (LOS) 10 with a difference angle Theta equal to +10 degrees (L) and −10 degrees (R).

Figure 11:
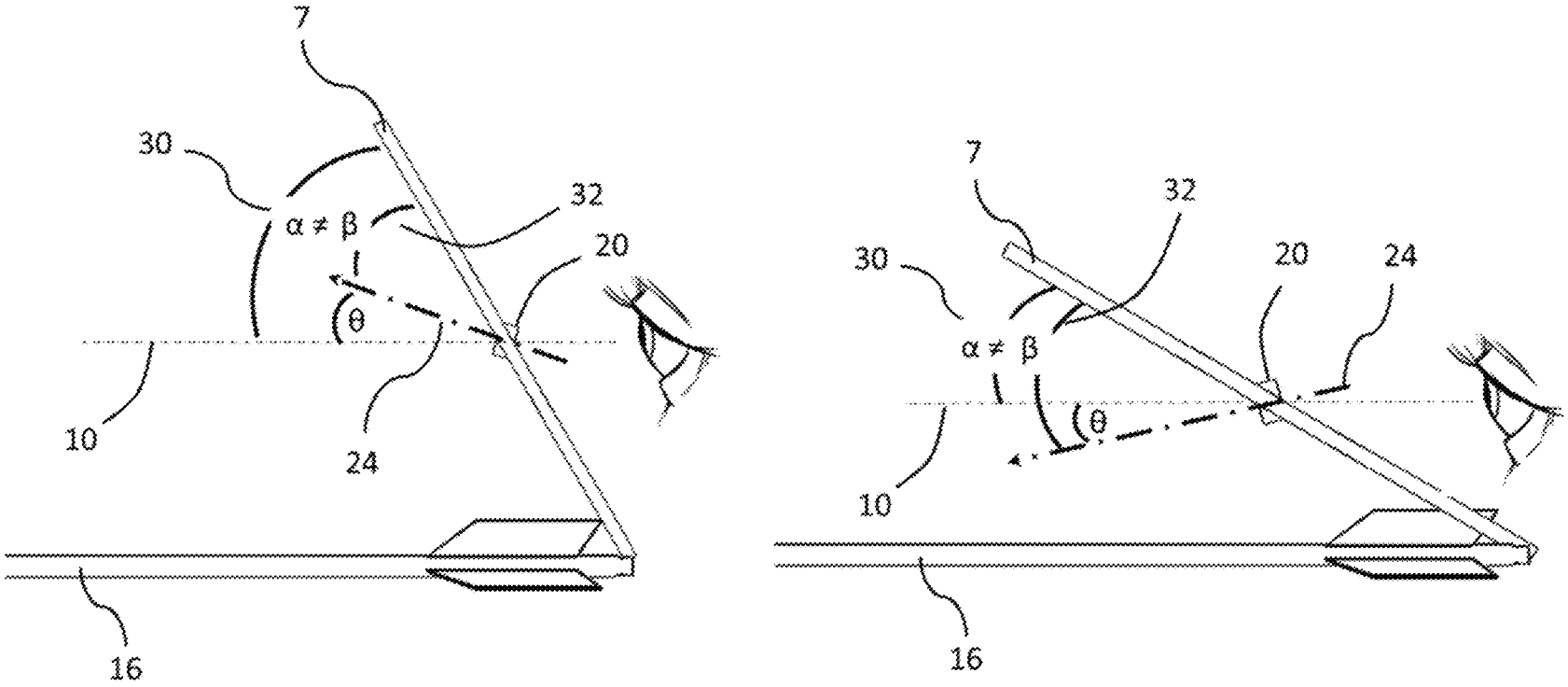
PRIOR ART Fig. 11
FIGS. 11A and 11B show examples of a conventional rear peep axis not co-aligned with the Line-Of-Sight (LOS) with a difference angle Theta equal to +10 degrees (L) and −10 degrees (R).

Existing rear peep sights 20 have a limited number of orientations as a result of the fixed string grooves 26 and 27 and 26' and 27' mounting feature (FIG. 8). Unless the string angle Phi 30 is equal to the mounting groove angle 32 ($\angle\beta$), there will always exist a co-alignment angular error $\angle\theta$ between the LOS 10 to the target 5 and the rear peep 20 aperture axis 24 when sighting and aiming a bow system 1 (FIGS. 6 and 11). The co-alignment angle error $\angle\theta$ ranges between about +10 degrees and about −10 degrees (FIG. 11). The invention disclosed herein provides the capability to adjust the inner body member aperture axis 63 to be collinear with the axis of the LOS 10 to the target 5, independent of the aperture axis 53 of the outer components, as it is fixed to the string angle ($\angle\alpha \neq \angle\beta$ where $\angle\theta \approx +/-10$ degrees).

Figure 12B:
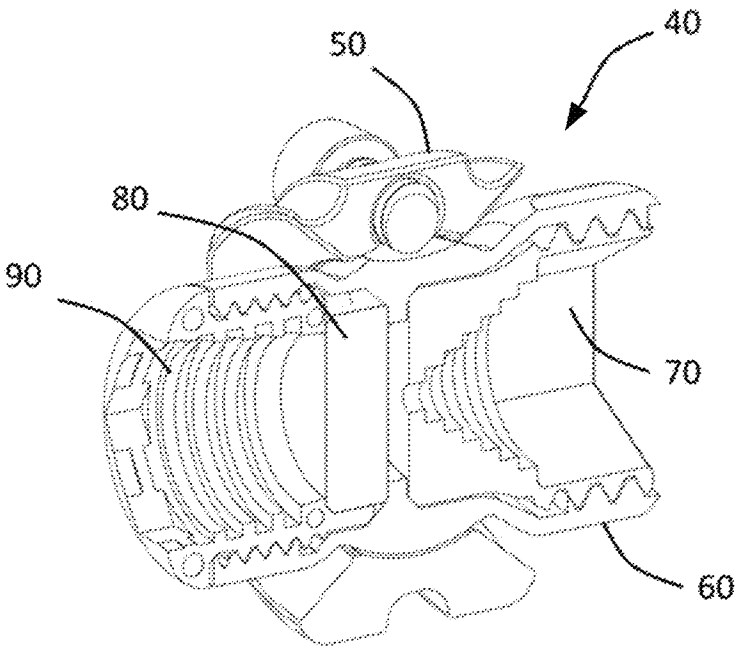
FIGS. 12A and 12B show examples of a peep assembly with an adjustable inner aperture component.
Figure 12A:
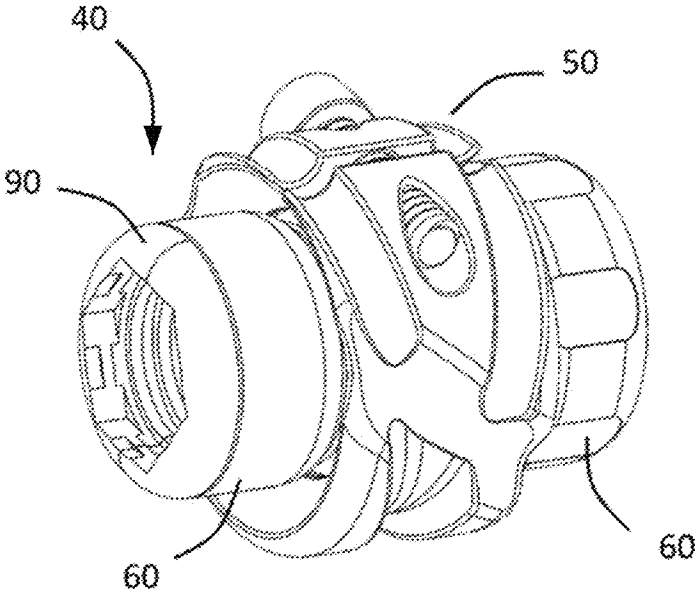
Figure 13:
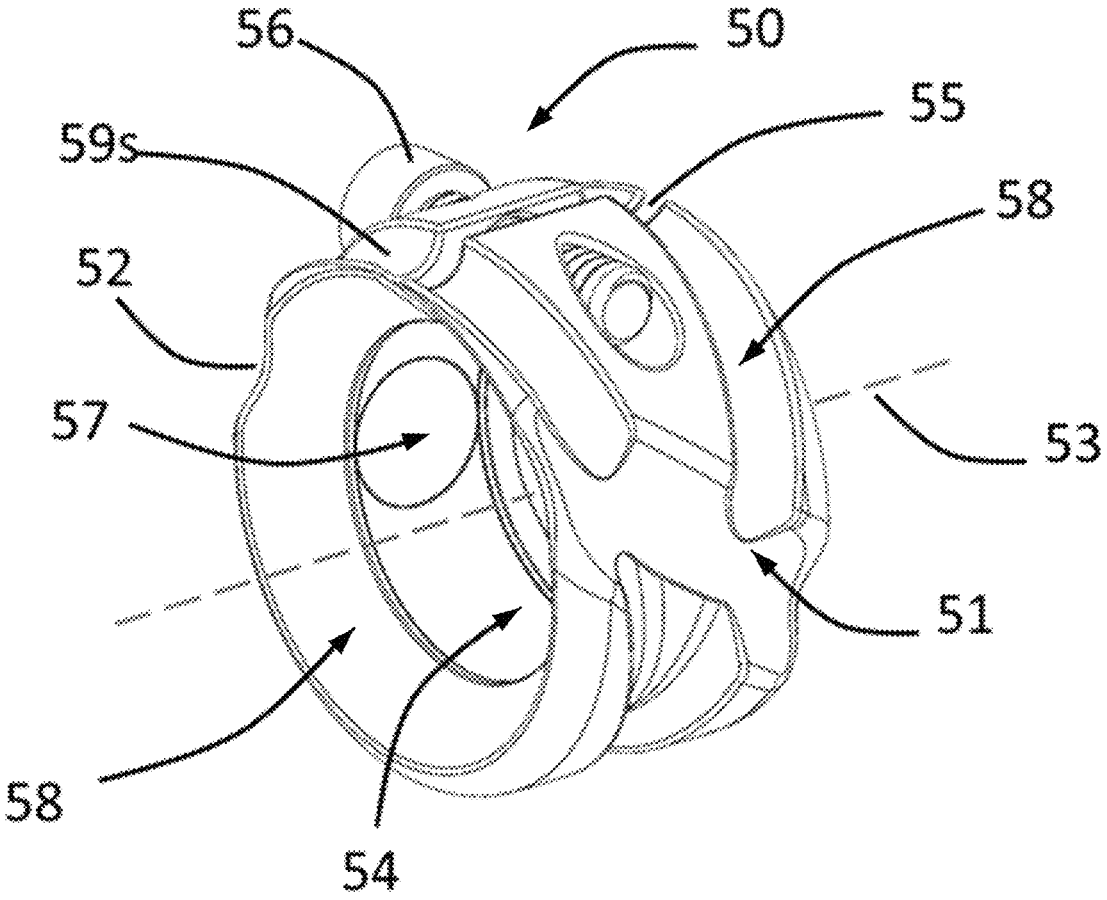
FIG. 13 shows an example outer component of the peep assembly with fixed string grooves.
Figure 14:
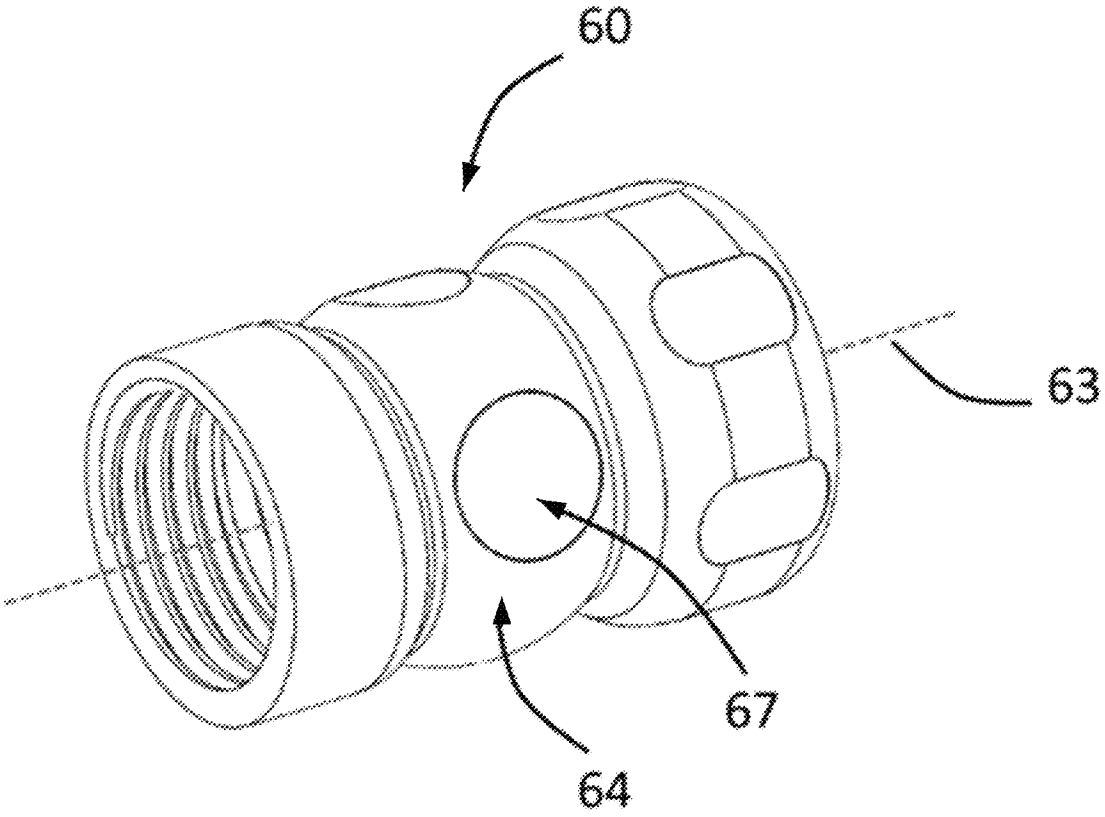
FIG. 14 shows an example inner aperture component of the peep assembly.

FIGS. 12A and 12B show examples of a peep assembly 40 with an adjustable inner body member aperture component 60. FIG. 13 shows an example peep assembly 40 with an outer component ring 50 having fixed string grooves 51 and 52. FIG. 14 shows an example inner aperture component 60 of the peep assembly 40.

In an example, the adjustable aperture axis peep sight device 40 includes an outer component (or "outer ring" or "outer sub-assembly") 50 having a first axis 53, and an inner aperture component (or "inner body member," "inner sub-assembly," or "inner peep component") 60 having a second axis 63. The first axis of the outer ring 50 forms a sight angle (FIG. 15) with the second axis of the inner body member 60. A first partially spherical surface is formed on the outer ring 50. A second partially spherical surface is formed on the inner body member 60. The first partially spherical surface movably mates with the second partially spherical surface. The sight angle is adjustable by moving the inner body member 60 relative to the outer ring 50.

In an example, the inner body member is substantially cylindrical. In an example, the first partially spherical surface is concave and the second partially spherical surface is convex. In another example, the first partially spherical surface is convex and the second partially spherical surface is concave.

In an example, the ring is split, and further comprising a connector 56 to join two ends of the outer ring 50 together and compress and lock the inner body member 60 position relative to the outer ring 50.

Figure 18:
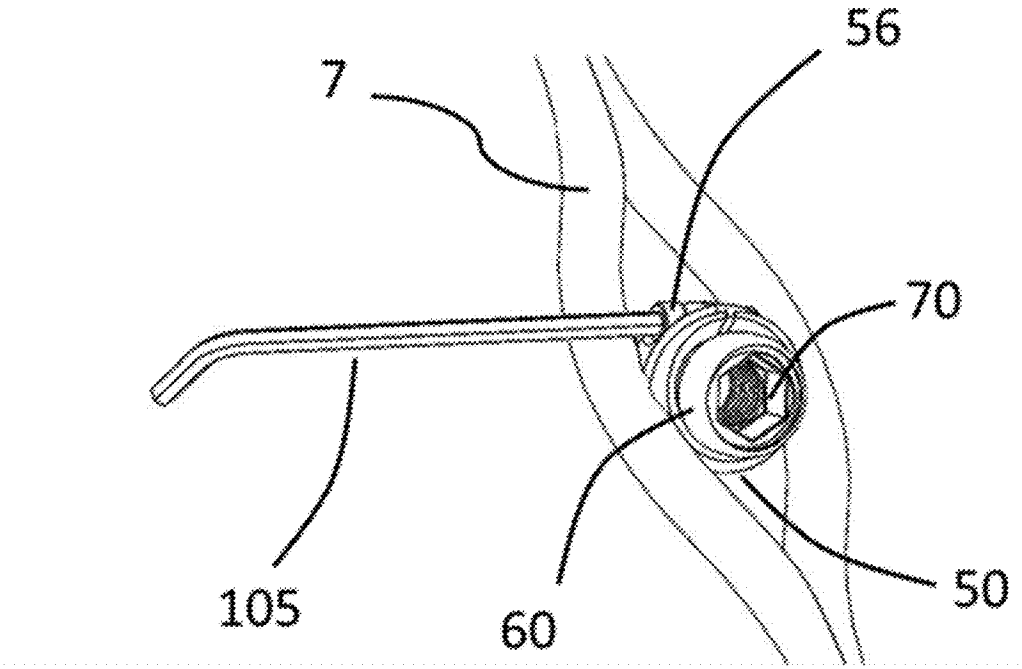
FIG. 18 shows an exploded view of an example peep assembly with a lateral locking/clamping mechanism and tool.

In an example, the outer ring 50 further comprises mounting channels opposite each other that non-negotiably couple the ring to a bow string 7. For example a circumferential mounting channel is shown formed in the outer ring 50 to receive a separate securing cord looped around a circumference of the outer ring for connecting to a bow string 7. Two radial grooves 59*a* and 59*b* join into one groove at an opposite side of the outer ring 50 and a lateral securement 56 to provide access to a clamping mechanism 56 with a tool 105 (FIG. 18).

In an example, a rear opening of the inner body member 60 receives a rear aperture 70. A forward opening of the inner body member 60 receives a front light baffle. The front light baffle may include an optional user selectable optical lens. Wherein the inner body member is usable without either front or rear inserts.

In an example, at least one leveling device 200 (FIG. 24) is attached to the inner body member 60 to assess a position of the second axis of the inner body member 60 relative to an axis of a line-of-sight to the target 5.

Figures 15A, 15B, 15C:
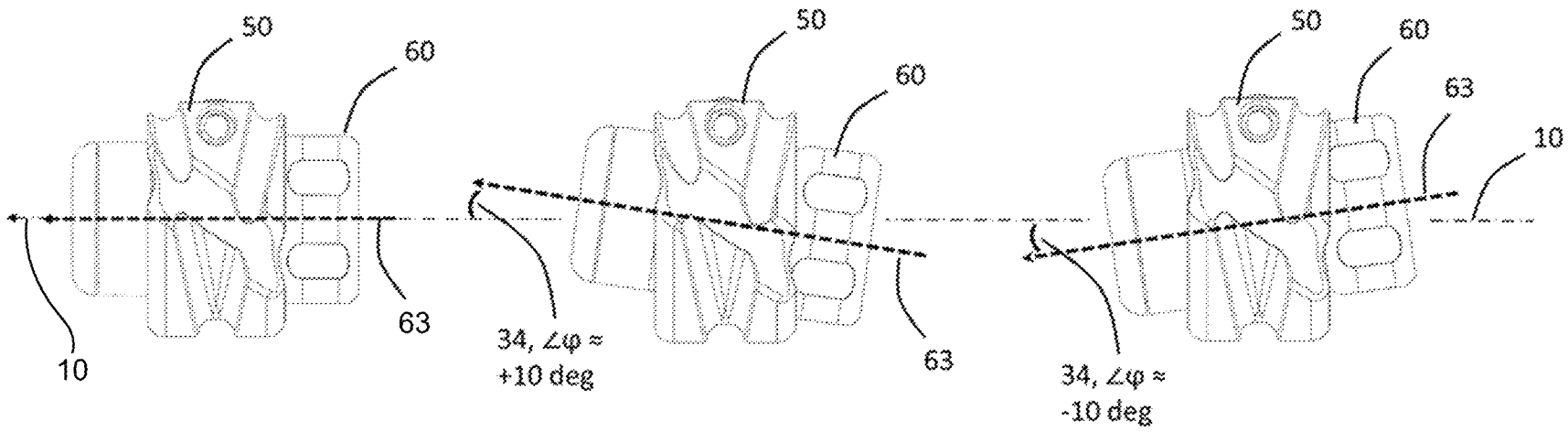
FIGS. 15A, 15B and 15C show examples of peep assembly adjustment, with the inner component co-aligned (L), +10 degrees (C.), and −10 degrees (L), with respect to the outer component.
Figure 16:
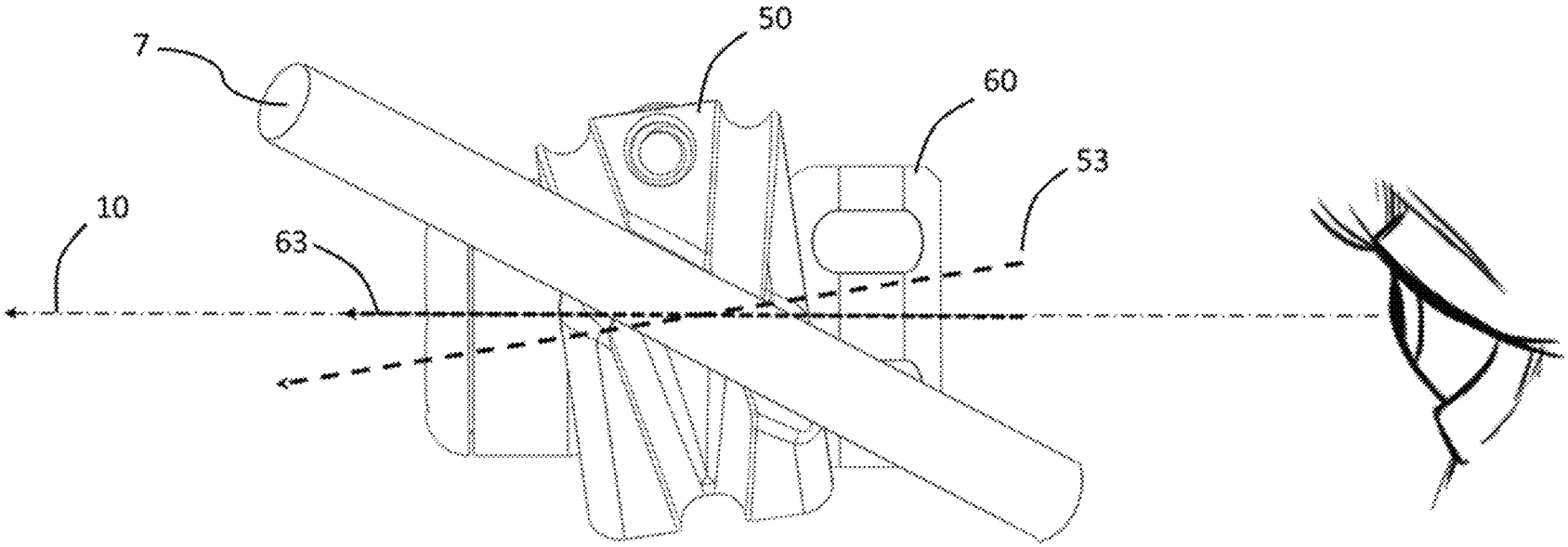
FIG. 16 shows an example peep assembly adjustment in situ, with the inner component co-aligned with the Line-Of-Sight (LOS), and the outer component m is-aligned with the Line-Of-Sight (LOS) and the inner component axis.
Figure 17:
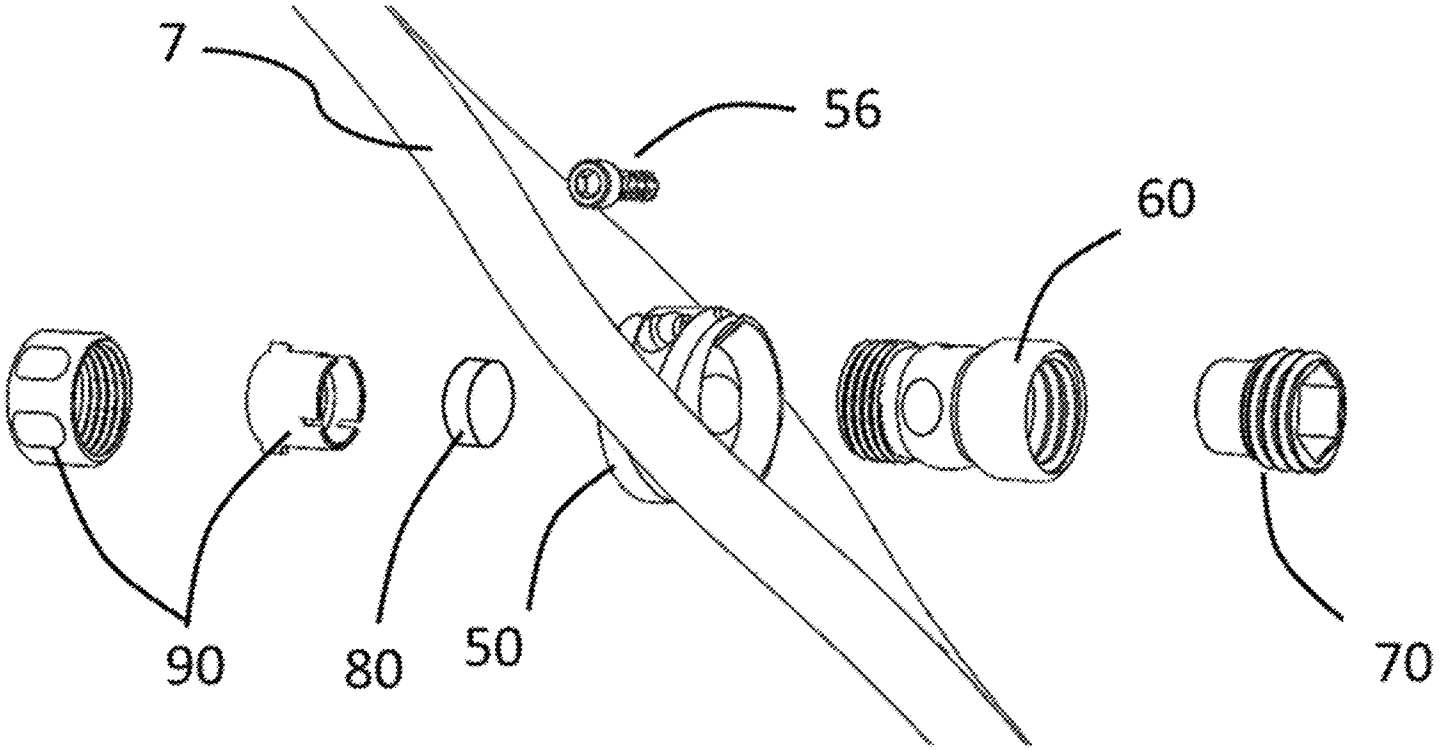
FIG. 17 shows an exploded view of an example peep assembly with a two piece baffle element.

FIGS. 15A, 15B and 15C show examples of peep assembly adjustment, with the inner component co-aligned (L), +10 degrees (C.), and −10 degrees (L), with respect to the outer component 50. FIG. 16 shows an example peep assembly adjustment in situ, with the inner aperture component 60 co-aligned with the Line-Of-Sight (LOS) 10, and the outer component 50 mis-aligned with the Line-Of-Sight (LOS) 10 when attached to bow string 7 and the axis of the inner aperture component 60. FIG. 17 shows an exploded view of the example peep assembly 40 with a two piece baffle element.

In an example, the inner aperture component 60 is adjusted independent of the outer component 50 across the sight angle having an angular range phi 34 (∠ϕ) of approximately +/−10 degrees. The independent adjustment co-axially aligns the second axis 63 of the inner aperture component 60 to a line-of-sight axis 10 to a target 5 resulting in an angle error theta greater than zero between the first axis 53 and the second axis 63.

During operation, the inner aperture component 60 is adjustable relative to the outer component 50. The outer component 50 is generally a circular shaped aperture device that mounts into the bow string 7 via a pair of complementary grooves 51 and 52 or 51*a* and 51*b* integral to the outer surface of the outer component 50 at a fixed orientation relative (approximately 45 degrees) to the aperture axis 53 and string angle alpha when the bow is at full draw. The outer component 50 has a front and aft end. Between the forward end and aft end is a spherical surface 54 that can be either concave or convex. The outer component has a relief slot 55 that allows for the diameter of the outer component 50 to increase when an inner aperture component 60 with a complementary spherical feature 64 is inserted and decreased when the clamping force is applied In an example, the outer component 50 has a clamping mechanism (e.g., mechanism 56) that reduces the diameter through mechanical force, such that its spherical shape 54 interferes with the complementary spherical shape 64 of the inner aperture component 60, to couple the components 50 and 60 relative to each other as assessed and set by the archer. Furthermore, the outer component 50 may have additional feature(s) 57 that limit the relative movement in the horizontal plane of the inner aperture component 60 when feature 67 and feature 57 are coplanar (FIGS. 13 and 14). Furthermore the outer component 50 has feature(s) 58 on the front and aft ends to allow for the inner aperture component 60 to pivot without interference between the components 50 and 60.

FIG. 18 shows a view of an example peep assembly with a lateral locking/clamping mechanism and tool. A radial two-groove feature 59*a* and 59*b* receives a separate securing cord to be looped around the circumference of the outer component 50 to secure the outer component 50 to the string 7. In one embodiment, the two-grooves join to form a single groove at the opposite side of the outer component 50 at the lateral securing feature 56 to allow access to the clamping mechanism 56 with tool 105 (FIG. 18). In another embodiment (FIG. 19), the string grooves 59*a* and 59*b* are two separate groves.

Figure 19:
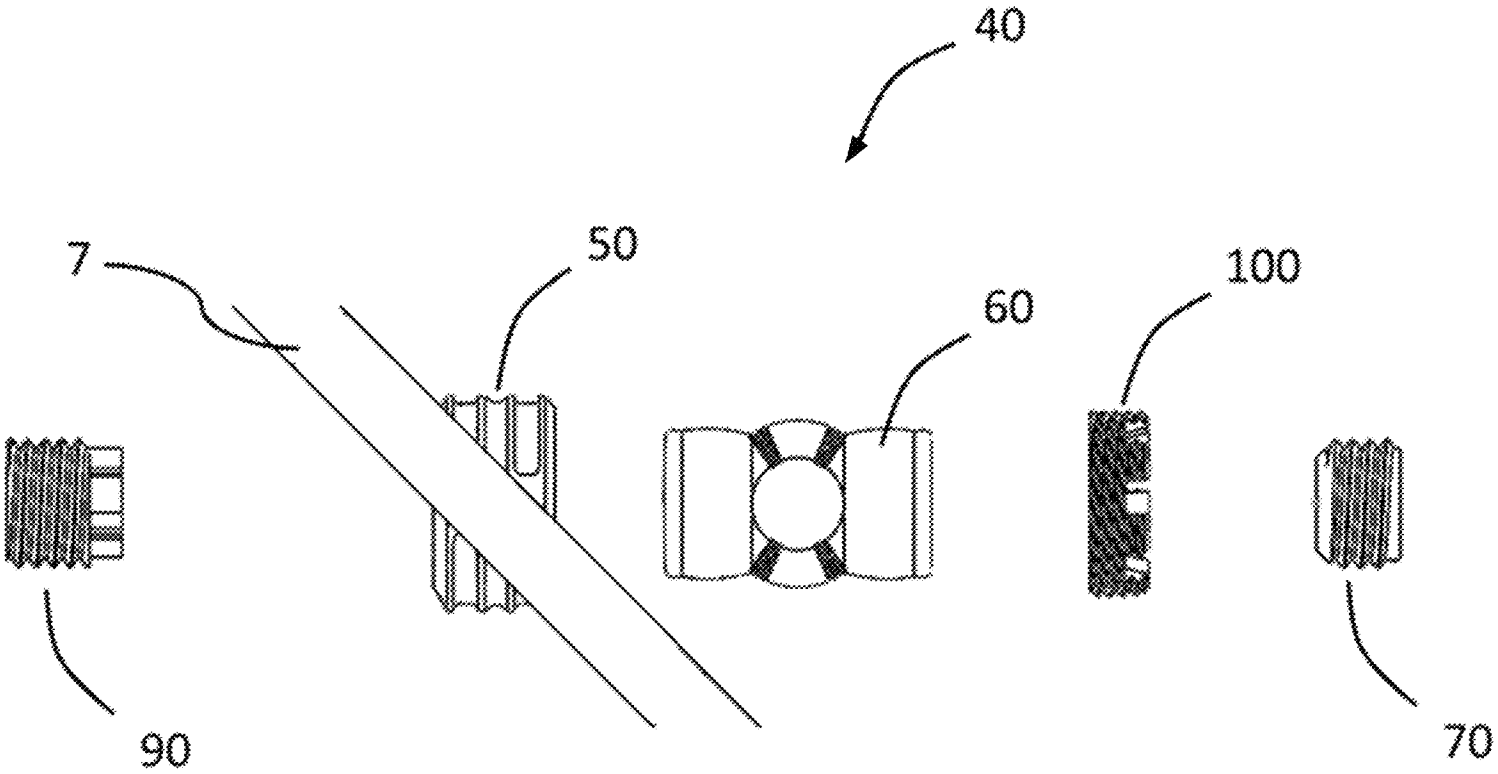
FIG. 19 shows an exploded view of an example peep assembly with an axial locking mechanism.
Figure 20:
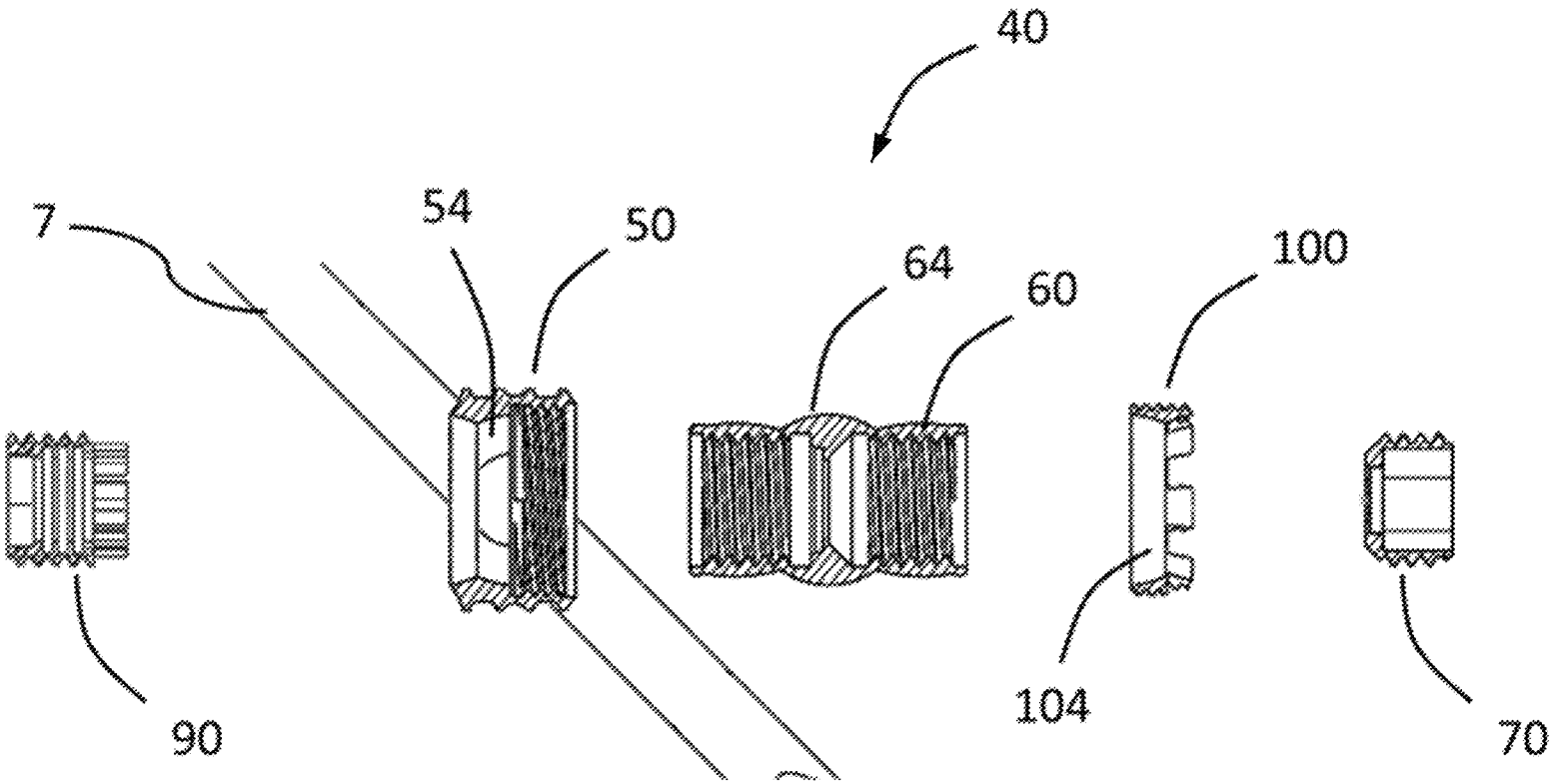
FIG. 20 is an exploded view showing an example cross section of a peep assembly with an axial locking mechanism.
Figure 21:
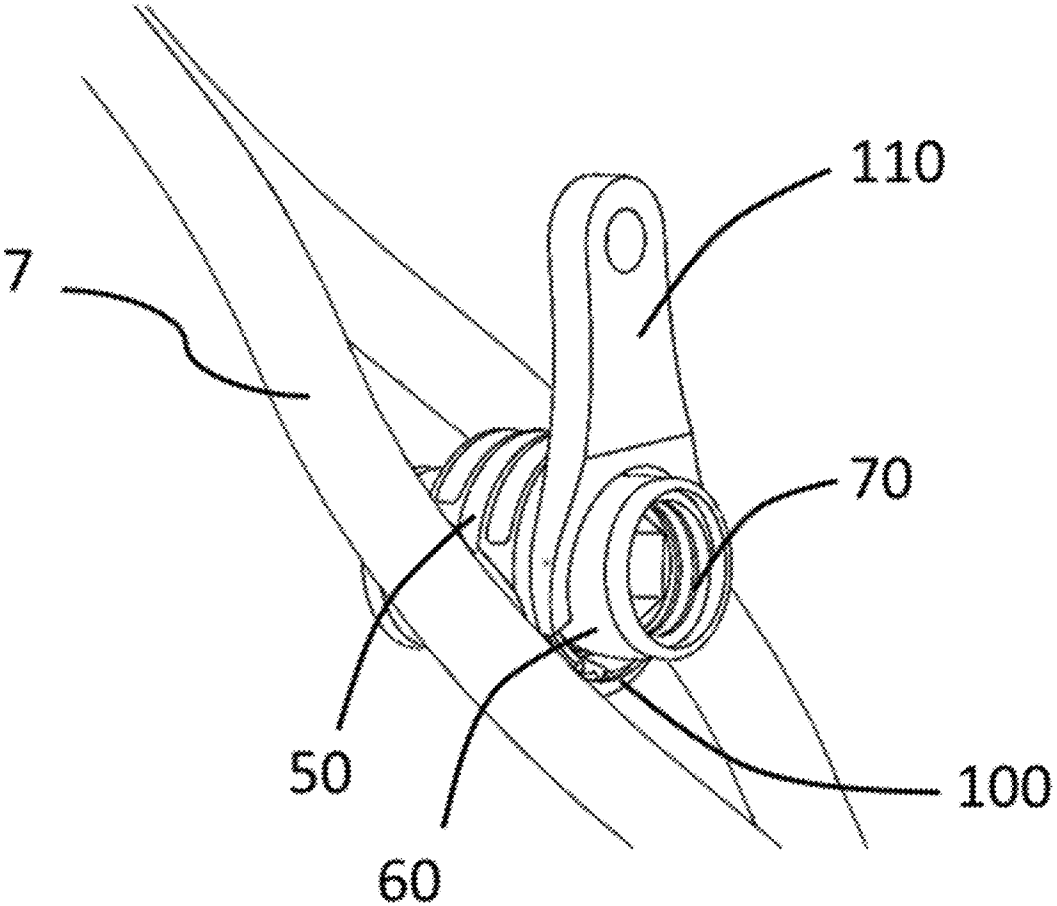
FIG. 21 shows an isometric view of an example peep assembly with an axial locking mechanism and locking tool.

FIG. 19 shows an exploded view of the example peep assembly with an axial locking mechanism. FIG. 20 is an exploded view showing an example cross section of a peep assembly with an axial locking mechanism. FIG. 21 shows an isometric view of the example peep assembly with an axial locking mechanism and locking tool.

In another example of a locking mechanism (FIGS. 20 and 21), the spherical shape 63 of the inner aperture component 60 is compressed with a threaded locking ring 100 that is applied in alignment of the axis 53 of the outer component 50. The locking mechanism 100 is threaded in and tightened with a tool 110, thus compressing complementary surfaces 54, 64 and 104. The result is the inner body member 60 is fixed relative to the outer ring 50.

Figure 22C:
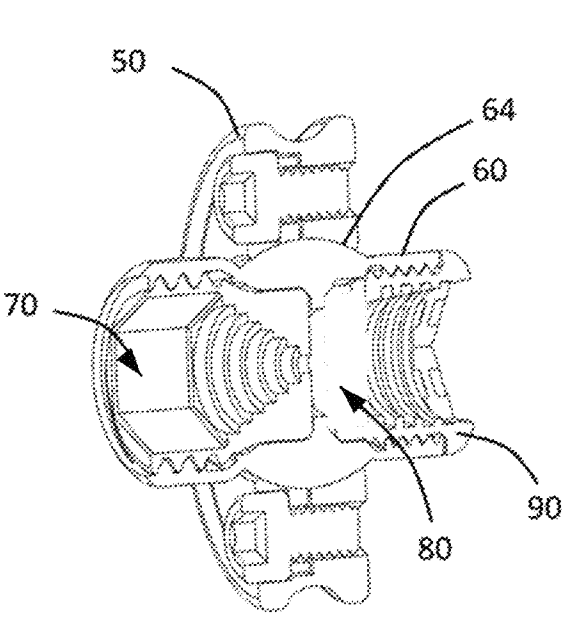
FIGS. 22A, 22B and 22C_are isometric views showing an example peep assembly with two-piece axial locking mechanism.
Figure 22B:
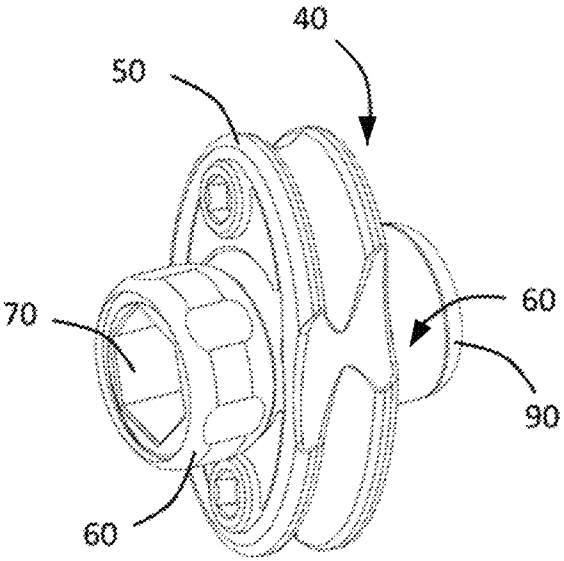
Figure 22A:
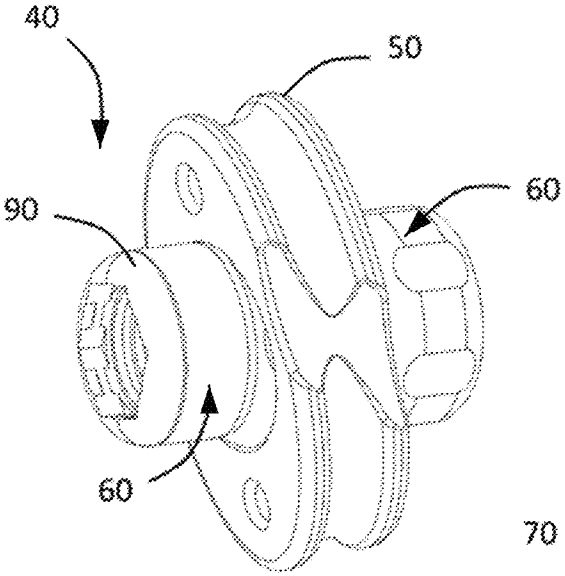
Figure 23C:
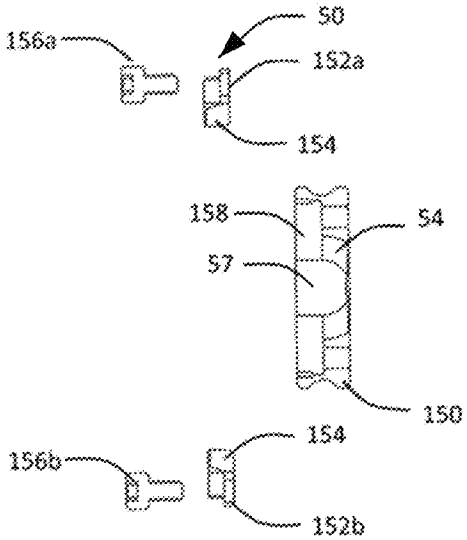
FIGS. 23A, 23B and 23C_are exploded views showing an example peep assembly with two-piece axial locking mechanism.
Figure 23B:
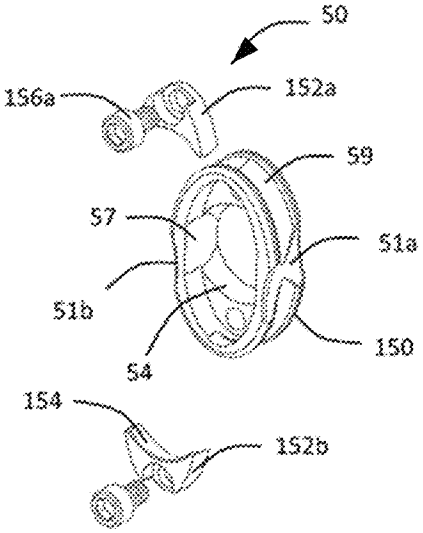
Figure 23A:
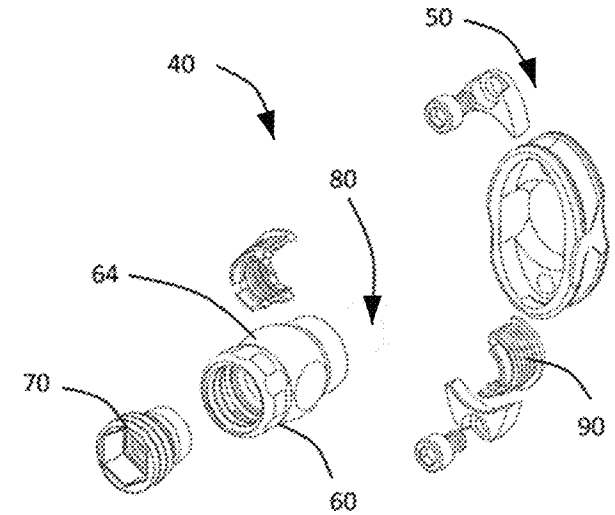

FIGS. 22A, 22B and 22C_are isometric views showing an example peep assembly with two-piece axial locking mechanism. FIG. 23-FIGS. 23A, 23B and 23C_are exploded views showing an example peep assembly with two-piece axial locking mechanism.

In an example of an axial locking mechanism (FIGS. 22A, 22B and 22C and FIGS. 23A, 23B and 23C), the outer component 50 has a cavity 158 that receives multiple locking elements 152*a* and 152*b* with spherical features 154. When coupled to body 150 with fasteners 156*a* and 156*b*, the inner aperture component 60 spherical feature 64 camps between surfaces 154 and 54 where these spherical surfaces encompass the spherical feature 64 of inner aperture component 60. When the clamping force applied by fasteners 156*a* and 156*b* is not applied, the inner aperture component 60 can pivot relative to the outer component 50. When the axial locking or clamping force is applied by fasteners 156*a* and 156*b* through elements 152*a* and 152*b*, the inner aperture component 60 and outer component 50 are positioned relative to each other to accommodate the angle error theta (∠θ).

The inner aperture component 60 of the peep assembly with associated axis 63 can be adjusted independent of the outer component 50 with aperture axis 53 across an angular range phi 34 (∠ϕ) of approximately +/−10 degrees (FIG. 15). This independent degree of adjustment allows the aperture axis 63 of the inner aperture component 60 to be co-axially aligned to the LOS 10 to the target 5 independent of the outer component 50 being non-negotiably coupled to the bow string 7. This independent adjustment enables the peep assembly 40 to be optimized to compensate for the co-aligned angle error theta (∠θ), which is dependent on the bow 3 length and the archer's draw length.

In an example, the inner aperture component 60 has a cylindrical or barrel shape with an outer spherical mating surface 64 (convex or concave). When mated to the inner surface 54 of the outer component 50 with a complementing spherical shape, this shape enables the axis 63 of inner aperture component 60 to pivot in a plane that intersects the surface of the target 5, and is parallel to the limiting feature 67. The inner aperture component 60 has an innermost mechanical reference 65 that serves as a dimensional reference for locating additional element(s) of the rear aperture insert 70, optional optical element 80 and baffle assembly 90 along axis 63 where the mechanical reference has conical or spherical shaped feature(s) 67*a* and 67*b* where the base meets the inner circumference of the inner diameter of the inner aperture component 60.

The barrel shape of the inner aperture component 60 has features (e.g., inner and outer threads 61 and 62) for accommodating additional element(s). Example element(s) include but are not limited to, light baffles 90 of a one-piece or multiple piece design, an optional optic 80 (where the optic can be powered, unpowered, clear or colored, single or multiple), and various sized insertable apertures 70.

These elements, when combined, make up the peep assembly 40 that includes outer component 50 and inner aperture component 60. The outer component is coupled to the bow string 7, and the inner aperture component 60 pivots relative to the outer component 50.

In an example, the inner aperture component 60 co-axial alignment to the LOS 10 is critically set at full draw (FIGS. 22A, 22B and 22C). To set the angular position of the inner aperture component 60, a bubble vial 200 (single or dual axis) or other level device may be coupled to the inner aperture component 60, where the axis 204 of the bubble vial 200 is collinear with the axis 63 of inner aperture component 60. The archer can adjust the inner aperture component 60 such that the bubble vial is level, representing the LOS 10 to the target. The outer component 50 with mechanism 56 can then be coupled to the inner aperture component 60 to set the relative angle phi 34 (∠ϕ).

In an example, the forward facing insert 70 with complementary threaded features may couple to the threaded feature 62 of the inner aperture component 60. The aperture has light baffles 74 that are larger than the smallest diameter 72 (e.g., the sighting aperture). A tool feature 76 enables a tool (not shown) to be inserted into the aperture to install it into the inner aperture component 60. Additionally, the insert 70 may also include a cavity 78 with optional threads (not shown) for an optical lens or lenses 80. The forward facing insert may also have external feature(s) (e.g., knurling, not shown) to allow for threaded insertion by the archer without the aid of an additional tool. The insert 70 can be of one piece or multiple that seats against the innermost mechanical reference 65 of the inner aperture component 60. The light baffles 74 may be separate from the insert and may not be included as part of the insert 70.

In an example, the rearward facing aperture insert 90 has a complementary threaded feature to couple to the threaded feature 61 of the inner aperture component 60. The light baffles 94 eliminate off-axis stray light. The light baffle can be of one piece or multiple, and includes a final aperture 92 to optimize the sight picture for co-aligning the inner body member axis 63 with the line of sight 10. Final aperture 92 may include a cavity (not shown) for an optional optic or lens 80 that seats against the innermost mechanical reference 65 of inner aperture component 60. The rearward facing aperture insert may include feature(s) to receive a tool (not shown) or have a feature that is greater than or equal to the minimum outer diameter of the inner body member (not shown) to aid in the threaded insertion of the insert 90 into the inner body member 60.

Figure 24B:
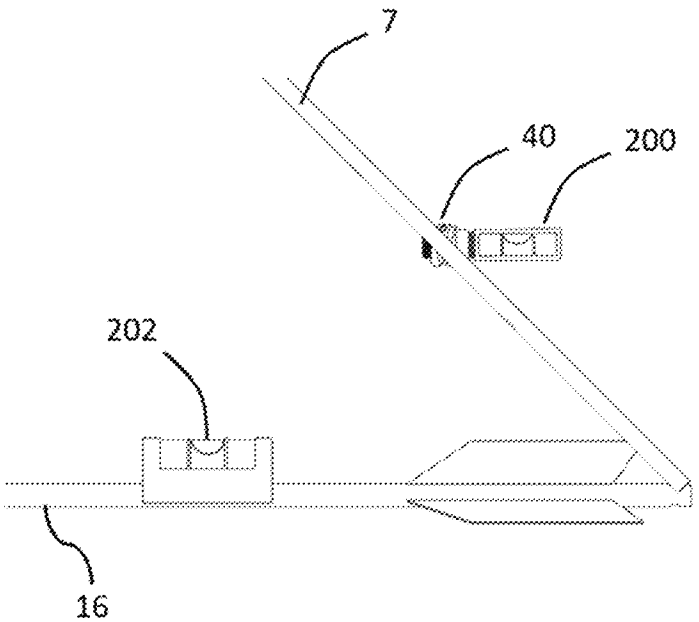
FIGS. 24A-B show (A) an example peep assembly in situ with an independent alignment tool, and (B) an alignment tool coupled to the peep assembly.
Figure 24A:
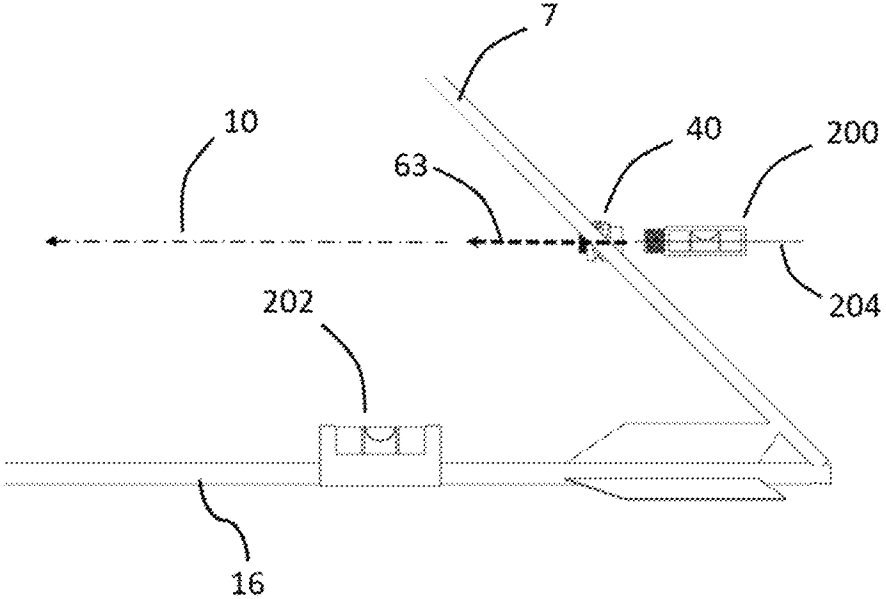
Figure 25B:
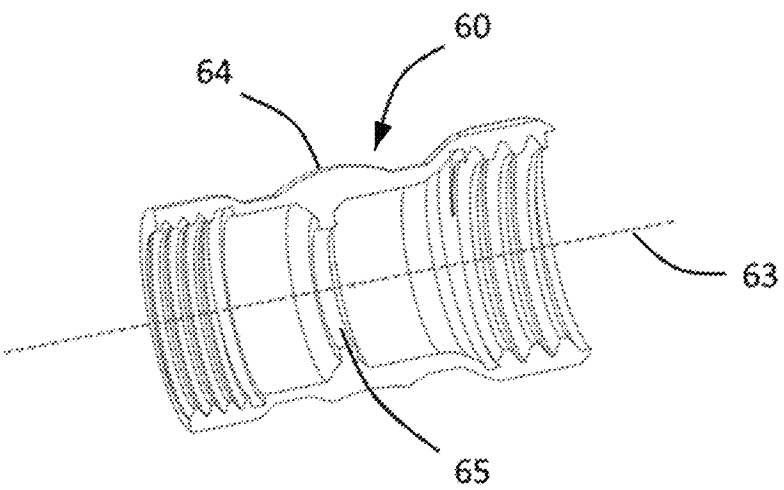
FIGS. 25A, 25B and 25C_are component views showing an example inner body member.
Figure 25A:
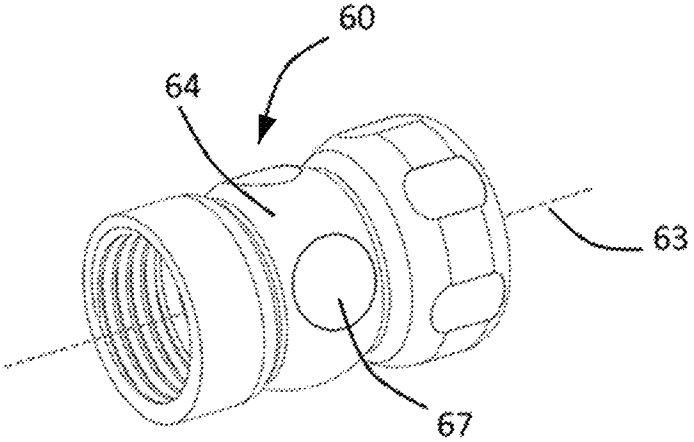
Figure 25C:
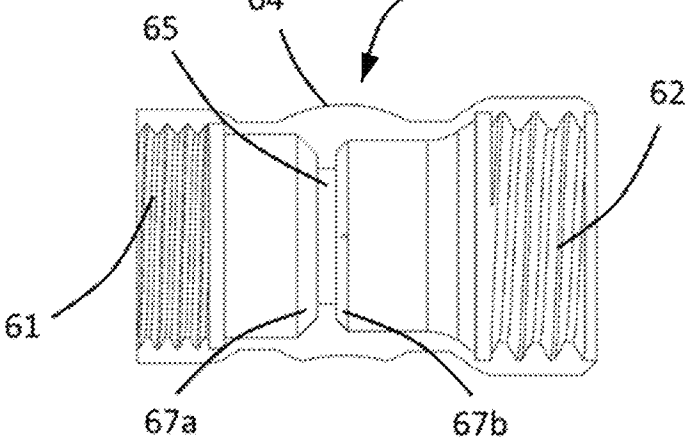

FIG. 24 show an example peep assembly 200 in situ with an independent alignment tool 202 (L), and the alignment tool 202 coupled to the peep assembly 200 (R). FIGS. 25A, 25B and 25C_are component views showing an example inner body member 60. FIGS. 26A, 26B and 26C are component views showing an example of rearward facing aperture insert 90 where the smallest aperture opening 92 ranges from 0.032" to 0.3125" in diameter and each unique aperture opening is embodied in a separate rearward facing aperture insert 90. Baffles features 94 are options; being integral (unitary) to the aperture 90 or as a separate component (not shown). Enabling features to aid in the installation of the rearward facing aperture insert 90 into the inner body member 60 include (but not limited to) a geometric shape (e.g. hexagon, star, circle, etc.) 96. As shown, the geometric shape 96 is internal to the rearward facing aperture 90 where the diameter is less than the minimum diameter of the inner body member, or can be embodied as a diameter feature which is larger than or equal to the minimum diameter of the outer surface of the inner body member 60.

Figure 27C:
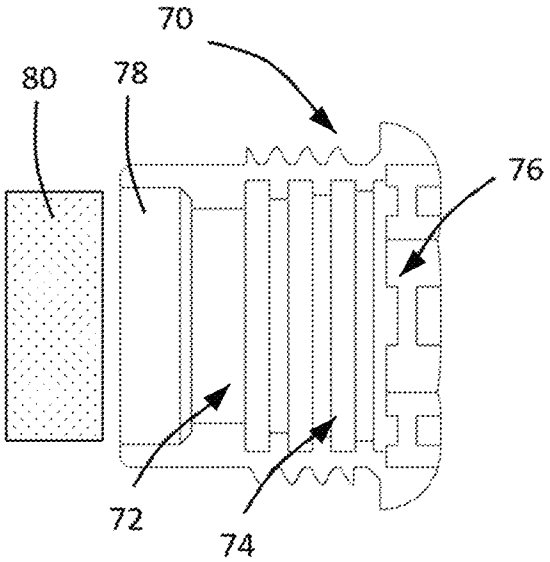
FIGS. 27A, 27B and 27C show other examples of a forward facing insert with optional light baffles and lens cavity (lens optional).
Figure 27B:
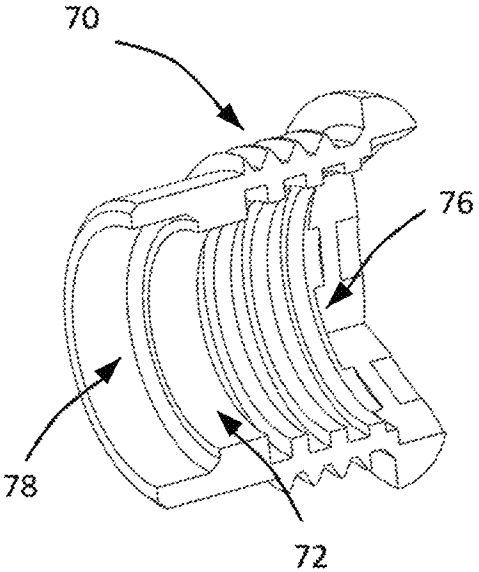
Figure 27A:
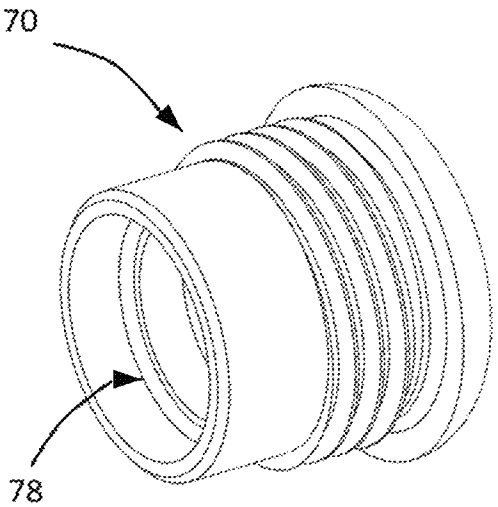

FIGS. 27A, 27B and 27C show other examples of the forward facing insert 70. The insert consists of the smallest diameter 72 defining the optical lens cavity 78 with optional optical element 80. The optical element interfaces interface member 65 of the inner body member 60. Baffle elements 74 are forward of the smallest diameter 72 with mounting features (e.g. external threads). Enabling geometric features 76 for installing the insert in the inner body member 60 with mating tool (e.g. hexagon wrench) not shown.

It is noted that the examples shown and described are provided for purposes of illustration and are not intended to be limiting. Still other examples are also contemplated.

The invention claimed is:

1. An adjustable aperture axis peep sight device, comprising:

an outer component having a first axis;

an inner body member having a second axis, the first axis of the outer component forms an offset angle with the second axis of the inner body member;

a first partially spherical surface formed on the outer component; and a second partially spherical surface formed on the inner body member, the first partially spherical surface movably mating with the second partially spherical surface;

wherein the offset angle is adjustable by moving the inner body member relative to the outer component;

wherein the outer component compresses the second partially spherical surface formed on the inner body member to orient the outer component and inner body member relative to each other.

2. The adjustable aperture axis peep sight device of claim 1, wherein the inner body member is adjusted independent of the outer component across the sight angle having an offset angular range phi (∠ϕ) of approximately +/−10 degrees.

3. The adjustable aperture axis peep sight device of claim 2, wherein the independent adjustment co-axially aligns the second axis of the inner body member to a line-of-sight axis to a target resulting in an offset angle error theta greater than zero between the outer component axis and the inner body member axis.

4. The adjustable aperture axis peep sight device of claim 1, wherein the inner body member is substantially cylindrical.

5. The adjustable aperture axis peep sight device of claim 1, wherein the first partially spherical surface is concave and the second partially spherical surface is convex.

6. The adjustable aperture axis peep sight device of claim 1, wherein the first partially spherical surface is convex and the second partially spherical surface is concave.

7. The adjustable aperture axis peep sight device of claim 1, wherein the outer component is split, and further comprising a connector to join two ends of the outer component together and compress and lock the inner body member position relative to the outer component.

8. The adjustable aperture axis peep sight device of claim 1, wherein the outer component further comprises mounting channels opposite each other that non-negotiably couple the outer component to a bow string.

9. The adjustable aperture axis peep sight device of claim 1, further comprising a circumferential mounting channel formed in the outer component to receive a separate securing cord looped around a circumference of the outer component for connecting to a bow string.

10. The adjustable aperture axis peep sight device of claim 9, further comprising two radial grooves that join into one groove at an opposite side of the outer component and a lateral securement to provide access to a clamping mechanism with a tool.

11. The adjustable aperture axis peep sight device of claim 1, wherein a rear opening of the inner body member receives a rear aperture.

12. The adjustable aperture axis peep sight device of claim 1, wherein a forward opening of the inner body member receives a forward facing light baffle.

13. The adjustable aperture axis peep sight device of claim 12, wherein the front light baffle further comprises a user selectable optical lens.

14. The adjustable aperture axis peep sight device of claim 1, further comprising at least one leveling device attached to the inner body member to assess a position of the inner body member's axis relative to the line of sight to the target.

15. An adjustable aperture axis peep sight device, comprising:

an outer component having a first partially spherical surface; and an inner body member having a second partially spherical surface;

wherein the first partially spherical surface mates with the second partially spherical surface;

wherein the inner body member moves relative to the outer component;

wherein the outer component compresses the second partially spherical surface of the inner body member to orient the outer component and inner body member relative to each other.

16. The adjustable aperture axis peep sight device of claim 15, further comprising an insert assembly having a lens cavity.

17. The adjustable aperture axis peep sight device of claim 16, wherein the insert assembly is insertable into a front portion of the inner body member.

18. The adjustable aperture axis peep sight device of claim 16, further comprising an assessment device of the inner body member to assess a position of an axis of the inner body member relative to a line-of-sight axis to a target where the angle between the axis of the inner body member and the line-of-sight axis to the target is near zero.

* * * * *